US012365519B2

(12) United States Patent
Campbell et al.

(10) Patent No.: US 12,365,519 B2
(45) Date of Patent: Jul. 22, 2025

(54) BITE-ACTUATED MOUTHPIECES AND DRINK VESSELS INCLUDING BITE-ACTUATED MOUTHPIECES

(71) Applicant: CAMELBAK PRODUCTS, LLC, Petaluma, CA (US)

(72) Inventors: Derek Campbell, Petaluma, CA (US); Eric Mar, San Rafael, CA (US); Thomas R. Luhrs, Santa Rosa, CA (US)

(73) Assignee: CAMELBAK PRODUCTS, LLC, Petaluma, CA (US)

( * ) Notice: Subject to any disclaimer, the term of this patent is extended or adjusted under 35 U.S.C. 154(b) by 377 days.

(21) Appl. No.: 17/827,229

(22) Filed: May 27, 2022

(65) Prior Publication Data

US 2022/0281654 A1 Sep. 8, 2022

Related U.S. Application Data

(63) Continuation of application No. 16/425,740, filed on May 29, 2019, now Pat. No. 11,345,523.
(Continued)

(51) Int. Cl.
*B65D 47/06* (2006.01)
*A45F 3/20* (2006.01)
(Continued)

(52) U.S. Cl.
CPC ..... *B65D 47/066* (2013.01); *A45F 3/20* (2013.01); *A47G 19/2266* (2013.01); *B65D 47/2031* (2013.01)

(58) Field of Classification Search
CPC ..... B65D 47/066; B65D 47/2031; A45F 3/20; A47G 19/2266; F16K 21/04
(Continued)

(56) References Cited

U.S. PATENT DOCUMENTS 4,690,375 A 9/1987 Vorhis
5,085,349 A 2/1992 Fawcett
(Continued)

FOREIGN PATENT DOCUMENTS

AU 2013361517 12/2013
CA 2902999 6/2014
(Continued)

OTHER PUBLICATIONS

English-language machine translation of German Utility Model No. DE 202006012915 U1, European Patnet Office, Dec. 24, 2016.
(Continued)

*Primary Examiner* — John Bastianelli
(74) *Attorney, Agent, or Firm* — Reed Smith LLP; Amardeep S. Grewal

(57) ABSTRACT

Bite-actuated mouthpieces and drink vessels including bite-actuated mouthpieces are disclosed. Bite-actuated mouthpieces comprise a body comprising a dispensing wall, one or more sidewalls extending from the dispensing wall that with the dispensing wall define an internal volume, and an inlet to the internal volume. The self-sealing exit is biased toward a closed configuration and is configured to be selectively reconfigured from the closed configuration to an open configuration responsive to user-applied compressive forces to opposing bite regions. The dispensing wall has a dispensing face opposite the internal volume, and in some examples, the dispensing face is concave.

18 Claims, 16 Drawing Sheets

Related U.S. Application Data

(60) Provisional application No. 62/678,715, filed on May 31, 2018.

(51) Int. Cl.
*A47G 19/22* (2006.01)
*B65D 47/20* (2006.01)

(58) Field of Classification Search
USPC ..... 251/342
See application file for complete search history.

(56) References Cited

U.S. PATENT DOCUMENTS

| | | | |
|---|---|---|---|
| 5,271,531 | A | 12/1993 | Rohr et al. |
| 5,390,805 | A | 2/1995 | Bilani et al. |
| 5,601,207 | A | 2/1997 | Paczonay |
| 5,730,336 | A | 3/1998 | Lerner |
| 5,950,878 | A | 9/1999 | Wade et al. |
| 6,032,831 | A | 3/2000 | Gardner et al. |
| 6,039,305 | A | 3/2000 | Hoskins et al. |
| 6,062,435 | A | 5/2000 | Hess, III |
| 6,070,767 | A | 6/2000 | Gardner et al. |
| 6,145,695 | A | 11/2000 | Garrigues |
| 6,279,772 | B1 | 8/2001 | Bowman |
| 6,364,168 | B1 | 4/2002 | Gardner et al. |
| 6,675,998 | B2 | 1/2004 | Forsman et al. |
| 6,708,950 | B2 | 3/2004 | Christensen et al. |
| 6,764,064 | B2 | 7/2004 | Sturm et al. |
| 6,874,760 | B2 | 4/2005 | Steckel |
| 6,886,807 | B1 | 5/2005 | Gill |
| 6,908,015 | B2 | 6/2005 | Choi et al. |
| 6,994,225 | B2 | 2/2006 | Hakim |
| 7,267,245 | B2 | 9/2007 | Yang |
| 7,533,783 | B2 | 5/2009 | Choi et al. |
| 7,806,300 | B1 | 10/2010 | Noell et al. |
| 8,152,138 | B2 | 4/2012 | Skillern |
| 8,177,097 | B2 | 5/2012 | Duran |
| 8,191,727 | B2 | 6/2012 | Davies et al. |
| 8,252,224 | B2 | 8/2012 | Blain |
| 8,267,283 | B2 | 9/2012 | Staton |
| 8,622,236 | B2 | 1/2014 | Sanbrook et al. |
| 8,640,928 | B2 | 2/2014 | Ellenkamp-Van Olst et al. |
| 8,701,928 | B2 | 4/2014 | Samson |
| 8,915,484 | B2 | 12/2014 | Harward et al. |
| 9,609,969 | B1 | 4/2017 | Panec et al. |
| 2002/0011583 | A1 | 1/2002 | Getzewich et al. |
| 2002/0092877 | A1 | 7/2002 | Bowman |
| 2003/0222238 | A1 | 12/2003 | Getzewich et al. |
| 2004/0089301 | A1 | 5/2004 | Choi et al. |
| 2005/0029313 | A1 | 2/2005 | Robins et al. |
| 2005/0184075 | A1 | 8/2005 | Belcastro |
| 2006/0201902 | A1 | 9/2006 | Brown et al. |
| 2006/0231561 | A1 | 10/2006 | Choi et al. |
| 2007/0039959 | A1 | 2/2007 | Choi et al. |
| 2007/0075094 | A1 | 4/2007 | Brown |
| 2013/0181005 | A1 | 7/2013 | Stribling et al. |
| 2014/0209644 | A1 | 7/2014 | Socier et al. |
| 2014/0263157 | A1 | 9/2014 | Aller |
| 2015/0014369 | A1 | 1/2015 | Hatton et al. |
| 2015/0368006 | A1 | 12/2015 | Wiesman |
| 2017/0066571 | A1 | 3/2017 | Panec et al. |

FOREIGN PATENT DOCUMENTS

| | | | |
|---|---|---|---|
| CN | 105228574 | A | 1/2016 |
| DE | 202006012915 | U1 | 10/2006 |
| EP | 0266067 | A1 | 5/1988 |
| EP | 2695549 | A2 | 2/2014 |
| EP | 2755899 | B1 | 3/2016 |
| EP | 2943177 | B1 | 2/2019 |
| GB | 2480582 | B | 9/2014 |
| GB | 2521886 | A | 7/2015 |
| WO | 00/03946 | A1 | 1/2000 |
| WO | 03/101261 | A1 | 12/2003 |
| WO | 2013/038179 | A1 | 3/2013 |
| WO | 2013/039482 | A1 | 3/2013 |
| WO | 2013/138087 | A1 | 9/2013 |
| WO | 2014/100168 | A1 | 6/2014 |
| WO | 2015/197599 | A1 | 12/2015 |

OTHER PUBLICATIONS

English-language abstract of Chinese Patent Publication No. CN 105228574 A, Jan. 6, 2016.
European Community Design Reg. No. 005830601-0001, European Union Intellectual Property Office, Nov. 27, 2018.
European Community Design Reg. No. 005835436-0001, European Union Intellectual Property Office, Nov. 20, 2018.
European Community Design Reg. No. 005835436-0002, European Union Intellectual Property Office, Nov. 27, 2018.
Cascade Designs bite valve, https://www.reddingsportsltd.com., retrieved Jan. 8, 2016.
Extended European Search Report in EP 19811602.2, Feb. 21, 2022, 9 pages.

BITE-ACTUATED MOUTHPIECES AND DRINK VESSELS INCLUDING BITE-ACTUATED MOUTHPIECES

RELATED APPLICATIONS

The present application is a continuation of U.S. patent application Ser. No. 16/425,740 filed May 29, 2019, which claims benefit of and priority to U.S. Provisional Patent Application No. 62/678,715 filed May 31, 2018, the disclosures of which are hereby incorporated by reference in their entirety.

FIELD

The present disclosure relates to bite-actuated mouthpieces and to drink vessels that include bite-actuated mouthpieces.

BACKGROUND

Bite-actuated mouthpieces, or bite valves, when used as a component of a drink container or a hydration system, permit a user to selectively consume drink liquid responsive to the user applying opposing compressive forces to (i.e., biting) the bite valve. Characteristics of bite valves that may be important to users may include (but are not limited to) the mouth-feel of a bite valve, the flow rate of drink liquid from the bite valve, the compressive forces required to operatively open a bite valve, the sealing (and conversely the leaking or weeping) of a bite valve, etc. Improvement in one characteristic may be detrimental to another characteristic. Bite valves configured for use with drink containers may require different design considerations and/or constraints than those configured for use with hydration systems and vice versa.

SUMMARY

Bite-actuated mouthpieces and drink vessels including bite-actuated mouthpieces are disclosed. Bite-actuated mouthpieces comprise a body having a dispensing wall and one or more sidewalls extending from the dispensing wall. The dispensing wall comprises a self-sealing exit. The one or more sidewalls and the dispensing wall define an internal volume, and the body further comprises an inlet to the internal volume. The one or more sidewalls comprise opposing bite regions. The self-sealing exit is selectively configured between a closed configuration, in which the self-sealing exit is closed and drink liquid in the internal volume may not be dispensed through the self-sealing exit, and an open configuration, in which the self-sealing exit is open and drink liquid in the internal volume may be dispensed through the self-sealing exit. The self-sealing exit is biased toward the closed configuration and is configured to be selectively reconfigured from the closed configuration to the open configuration responsive to user-applied compressive forces to the opposing bite regions. In some embodiments, the dispensing wall has a concave dispensing face opposite the internal volume.

In some embodiments, a thickness of the dispensing-wall decreases toward the longitudinal axis of the bite-actuated mouthpiece relative to the one or more sidewalls.

In some embodiments, the one or more sidewalls define a barrel section of the body that extends around the internal volume, and the body further comprises a flange that extends from the barrel section away from the internal volume.

In some embodiments, the body comprises a mouthpiece portion and a crimp tube that extends from the mouthpiece portion. The crimp tube is configured to be operatively and selectively crimped and uncrimped by corresponding structure of the drink container responsive to user manipulation of the drink container, such that the drink container defines an on/off valve that is distinct from the self-sealing exit. In some embodiments, the body further includes an anchor structure that is connected to the crimp tube distal the mouthpiece portion. The anchor structure is configured to engage with corresponding structure of a component of a drink container to restrict unintentional removal of the bite-actuated mouthpiece from the component of the drink container.

DESCRIPTION

Bite-actuated mouthpieces 10 and drink vessels 13 including bite-actuated mouthpieces 10 are disclosed herein and schematically represented in FIGS. 1-8. Generally, in these figures, elements that are likely to be included in a given example are illustrated in solid lines, while elements that are optional to a given example are illustrated in broken lines. However, elements that are illustrated in solid lines are not essential to all examples of the present disclosure, and an element shown in solid lines may be omitted from a particular example without departing from the scope of the present disclosure. Moreover, elements that are illustrated in broken lines may be important to a particular example.

Figure 1:
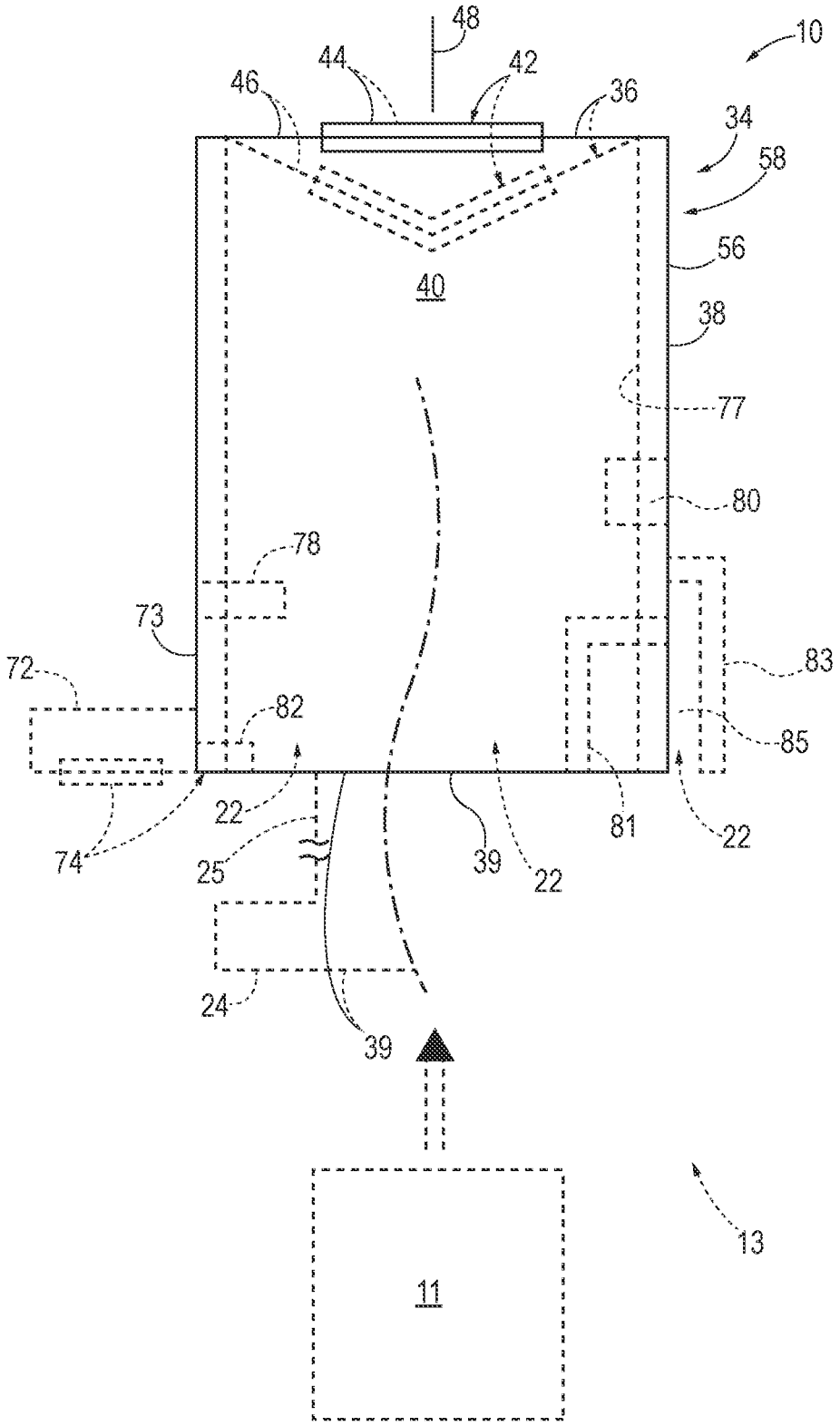
FIG. 1 is a schematic representation of examples of bite-actuated mouthpieces and drink vessels according to the present disclosure.
Figure 2:
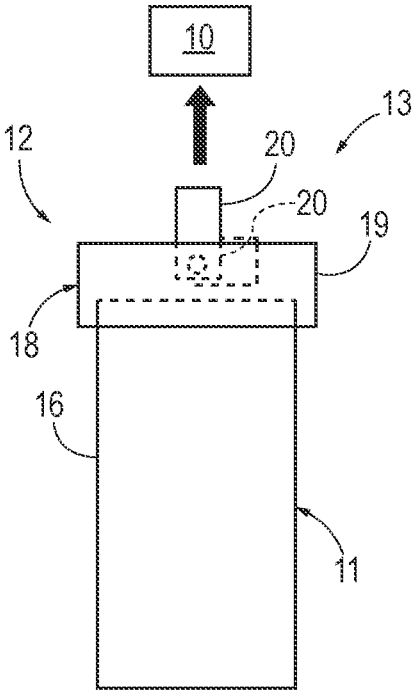
FIG. 2 is a schematic representation of examples of drink containers according to the present disclosure.
Figure 3:
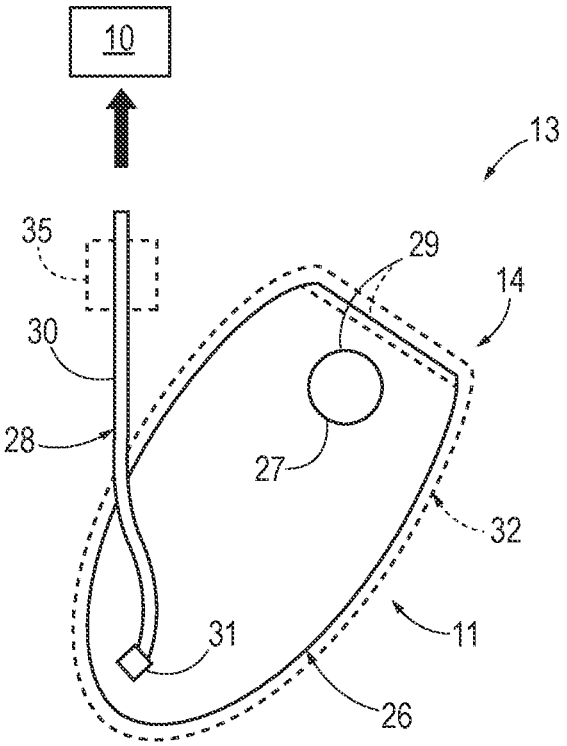
FIG. 3 is a schematic representation of examples of hydration systems according to the present disclosure.

With initial reference to FIG. 1, examples of bite-actuated mouthpieces 10 are schematically illustrated. As schematically represented, a bite-actuated mouthpiece 10 may be used together with at least a liquid reservoir 11 to define a drink vessel 13, such as a drink container 12 or a hydration system 14, examples of which are schematically represented in FIGS. 2 and 3, respectively. Bite-actuated mouthpieces 10 are configured to dispense drink liquid to a user's mouth upon receipt of user-applied compressive forces to the bite-actuated mouthpieces 10, such as to opposed sidewalls, or opposed bite regions, of the body of the mouthpieces. Moreover, bite-actuated mouthpieces 10 are biased to a sealed, or closed, configuration, in which the bite-actuated mouthpieces prevent drink liquid from being dispensed from the mouthpieces. Thus, bite-actuated mouthpieces 10 nominally remain in a closed configuration until receipt of sufficient user-applied compressive forces to configure the mouthpieces to a dispensing, or open, configuration, in which drink liquid may be dispensed, or flow, through the bite-actuated mouthpieces. Upon removal of the user-applied compressive forces, the bite-actuated mouthpieces 10 are biased to automatically return to the closed configuration, thereby restricting or preventing unintentional or undesired dispensing of drink liquid through the mouthpieces when a user is not biting upon the mouthpieces to impart the necessary user-applied compressive forces. In view of the above, bite-actuated mouthpieces 10 additionally or alternatively may be described or referred to as bite-valves, bite-actuated valves, self-sealing valves, valve assemblies, self-sealing valve assemblies, self-sealing mouthpieces, and/or mouthpieces.

In FIG. 1, examples of bite-actuated mouthpieces 10 according to the present disclosure are illustrated very schematically, with FIGS. 2-3 providing schematic representations of examples of drink vessels 13 according to the present disclosure, with FIGS. 4-8 providing less schematic representations of examples of bite-actuated mouthpieces according to the present disclosure, and with FIGS. 9-33 further providing specific examples of bite-actuated mouthpieces 10 and drink vessels 13 according to the present disclosure. It is within the scope of the present disclosure that the structure, features, properties, dimensions, characteristics, and/or properties described and/or illustrated in connection with the more schematic examples of FIGS. 1-8 may be applied to the less schematic examples of FIGS. 9-33. Conversely, structure, features, dimensions, characteristics, and/or properties described and/or illustrated in connection with the more specific examples of FIGS. 9-33 may be included with any of the other bite-actuated mouthpieces 10 disclosed herein, including in the more schematic examples of FIGS. 1-8.

In FIG. 1, bite-actuated mouthpieces 10 are schematically represented with various structures corresponding to multiple embodiments of bite-actuated mouthpieces according to the present disclosure. The dash-dot wavy line separates the lower portion of the schematically represented bite-actuated mouthpieces into a left side and right side, with each of the left side and the right side schematically illustrating various optional structures that may be utilized in some bite-actuated mouthpieces 10 but not in other bite-actuated mouthpieces 10. Other bite-actuated mouthpieces 10 may include structures illustrated on both the left side and the right side, and individual embodiments are not limited to only including structure from one of the left side and the right side of FIG. 1.

With continued reference to FIG. 1, bite-actuated mouthpieces 10 include a body 34 having a dispensing wall 36 and one or more sidewalls 38 that extend from the dispensing wall. The dispensing wall 36 and the one or more sidewalls 38 define an internal volume 40 for operative delivery of drink liquid to a user from an upstream liquid source, such as a liquid reservoir 11 of a drink vessel 13. As used herein, the terms "downstream" and "upstream" relate to the typical direction of flow of a drink liquid from a liquid reservoir 11 to a bite-actuated mouthpiece 10 and subsequently to a user via the exit of the bite-actuated mouthpiece. Thus, the terms may be used to positionally relate elements with respect to each other, such as by describing an element that is upstream from a bite-actuated mouthpiece 10 and/or describing an element that is downstream from a liquid reservoir 11.

Bite-actuated mouthpieces 10 further comprise an inlet 39 to the internal volume through which drink liquid enters internal volume 40 from an upstream component of a drink vessel 13. Inlet 39 may be generally opposed to the dispensing wall 36, such as being on the opposite side of internal volume 40 as the dispensing wall, with drink liquid from the liquid reservoir flowing into the bite-actuated mouthpiece through inlet 39, to internal volume 40, and then being selectively dispensed from the bite-actuated mouthpiece through the dispensing wall 36. However, it also is within the scope of the present disclosure that the inlet 39 is not directly opposite the dispensing wall and instead may be transverse to the dispensing wall, such as extending through the one or more sidewalls 38.

The one or more sidewalls 38 may be described as including opposing bite regions 56, such that the self-sealing exit reconfigures from the closed configuration to the open configuration responsive to user-applied compressive forces to the opposing bite regions. For example, a user may place at least a portion of the mouthpiece in the user's mouth and bite upon the bite regions to urge the mouthpiece from the closed configuration to the open configuration, thereby enabling the user to receive drink liquid from the drink vessel to which the bite-actuated mouthpiece is coupled.

The one or more sidewalls 38 may be described as forming, or forming at least a substantial portion of, a barrel section 58 of the body 34, with the barrel section extending around and/or defining at least a substantial portion, if not all, of the internal volume 40. Barrel section 58 may have various suitable or desired shapes for at least partial insertion into a user's mouth. Examples of suitable shapes include shapes that are, or include, arcuate, or curved, surfaces and/or one or more flat faces extending parallel to the general direction of liquid flow through the bite-actuated mouthpiece.

The dispensing wall 36 has a dispensing face 46 opposite the internal volume, and the dispensing wall comprises, has, and/or defines a self-sealing exit 42 that extends through the dispensing wall 36 from the internal volume 40 to the dispensing face 46. Self-sealing exit 42 additionally or alternatively may be referred to as a self-sealing outlet 42, an exit 42, and/or an outlet 42. In some examples, the self-sealing exit 42 includes, defines, and/or is defined by at least one slit 44 extending through the dispensing wall 36. For example, self-sealing exit 42 may include one (i.e., a single) slit 44, two slits 44, two parallel slits 44, two intersecting slits 44, two non-intersecting slits 44, or more than two slits 44. When the self-sealing exit 42 includes at least one slit and when the self-sealing exit is in the closed configuration, opposing faces of the at least one slit are engaged together to restrict liquid flow through the self-sealing exit. In contrast, when the self-sealing exit is in the open configuration, the opposing faces of the at least one slit are separated to permit liquid flow through the self-sealing exit.

In some bite-actuated mouthpieces 10 according to the present disclosure, the dispensing face has a concave configuration, in that a portion of the dispensing face that lies along the longitudinal axis 48 of the mouthpiece is closer to the inlet of the mouthpiece than is a portion of the dispensing face that intersects, or is joined with, the sidewalls 38 of the mouthpiece.

In some examples, the bite-actuated mouthpiece 10, as a whole, or at least the body 34 thereof, is constructed as a single monolithic body, such as via a molding process. In other examples, the bite-actuated mouthpiece 10 may be constructed of more than one monolithic body. For example, an over-molding process may be used to construct the mouthpiece, such as with the dispensing wall 36 being constructed of one piece and the sidewalls 38 being constructed of a second piece that is molded over the dispensing wall. Other configurations also are within the scope of the present disclosure. Mouthpiece 10, or at least body 34 thereof, may be formed from a resilient material, such as silicone, that is suitable for use to contact and deliver potable liquids to a user's mouth.

In FIGS. 2 and 3, examples of drink vessels 13 in the form of a drink container 12 and a hydration system 14 are schematically represented to graphically represent that bite-actuated mouthpieces 10 according to the present disclosure may be utilized to selectively dispense drink liquid from such drink vessels as a drink container or a hydration system. For example, a bite-actuated mouthpiece 10 may be mounted, installed, and/or otherwise coupled in fluid communication with the drink vessel's liquid reservoir 11 (i.e., liquid-storage region or the interior storage compartment of a drink container's liquid vessel or a hydration system's liquid bladder/reservoir).

Examples of drink containers 12 include a water bottle, a sports bottle, a squeeze bottle, a semi-rigid bottle, a collapsible flask, insulated bottles, double-walled bottles, and the like. Drink container 12 may include a rigid, semi-rigid, resilient, or collapsible (non-resilient) liquid vessel 16 that is sized to hold a volume of drink liquid for selective dispensing to a user via the bite-actuated mouthpiece 10. Drink container 12 may include a cap, or cap assembly, 18 that is mechanically coupled to an opening of the liquid vessel, such as by a threaded or friction-fit mechanism, to obstruct the opening of the liquid vessel and thereby limit dispensing of drink liquid from the liquid vessel except through selective actuation of bite-actuated mouthpiece 10. In some examples, the bite-actuated mouthpiece 10 may be a component or subcomponent of, or integral to, a cap assembly 18 of a drink container 12.

Examples of maximum fluid volumes of drink liquid that may be stored in liquid vessel 16 (i.e., the capacity of the liquid vessel 16) include at least 6 fluid ounces, at least 8 fluid ounces, at least 10 fluid ounces, at least 12 fluid ounces, at least 15 fluid ounces, at least 20 fluid ounces, at least 24 fluid ounces, at least 28 fluid ounces, at least 30 fluid ounces, at least 40 fluid ounces, at most 60 fluid ounces, at most 50 fluid ounces, at most 40 fluid ounces, at most 30 fluid ounces, at most 20 fluid ounces, at most 14 fluid ounces, in the range of 6-20 fluid ounces, in the range of 10-30 fluid ounces, in the range of 15-40 fluid ounces and/or in the range of 20-40 fluid ounces. Capacities of the liquid vessel that are outside of these examples are still within the scope of the present disclosure. Some drink containers 12, such as rigid and semi-rigid liquid containers, may be described as being free-standing liquid containers and/or upright liquid containers, in that the liquid containers retain a nominal shape and may remain in an upright configuration when placed on a level surface. Some liquid containers, such as (non-resiliently) collapsible liquid containers and/or soft flasks may have flexible liquid vessels 16 that do not have a nominal shape and instead generally conform to the shape of a surface against which the liquid vessel is placed.

Examples of drink containers 12 that may include and/or be operatively coupled to a bite-actuated mouthpiece 10 according to the present disclosure are disclosed in U.S. Pat. Nos. 8,252,224, 8,191,727, and 7,533,783, the disclosures of which are hereby incorporated by reference.

As schematically represented in FIG. 3, a bite-actuated mouthpiece 10 may be a component of a hydration system 14. A hydration system 14 includes a flexible bladder, or liquid reservoir, 26 that is sized to hold a volume of drink liquid for selective dispensing to a user via the bite-actuated mouthpiece 10. Examples of suitable maximum liquid volumes for liquid reservoir 26 (i.e., the capacity of the liquid reservoir 26) of a hydration system 14 include at least 0.5 liters (L), at least 0.75 L, at least 1 L, at least 1.5 L, at least 2 L, at least 2.5 L, at least 3 L, at most 6 L, at most 5 L, at most 4 L, at most 3 L, at most 2 L, in the range of 0.5-1.5 L, in the range of 1.5-2.5 L, and/or in the range of 2.5-3.5 L. Capacities that are outside of these examples also are within the scope of the present disclosure. Liquid reservoir 26 typically includes a fill port, or fill opening, 27 through which drink liquid is poured into the liquid reservoir, with fill port 27 typically being selectively sealed with a cap, fold, clamp, or other closure 29. Liquid reservoir 26 typically also includes an exit port 31 through which drink liquid from the liquid reservoir may flow to the bite-actuated mouthpiece 10 via an elongate flexible drink tube 30.

In a hydration system 14, the elongate flexible drink tube 30 fluidly interconnects the liquid reservoir 26 with the bite-actuated mouthpiece 10, optionally via one or more liquid ports or connections between the reservoir and the drink tube and between the drink tube and the mouthpiece. The elongate drink tube 30 and other components of the hydration system that are downstream from liquid reservoir 26 may be referred to as the downstream assembly 28 of the hydration system. As examples, downstream assembly 28 also may include one or more additional components 35, such as (but not limited to) an on/off valve configured to selectively obstruct the liquid flow through the elongate drink tube 30, a quick connect assembly configured to selectively and fluidly interconnect at least two fluidly interconnected components of the downstream assembly 28, a pump, a filter, and/or a liquid flowmeter. A hydration system 14 may include, and/or may be configured to be operatively received by, a pack, a body-worn pack, a garment, or other carrying structure, or carrier, 32.

Examples of hydration systems 14, carriers 32, components 35, and/or accessories therefor that may be utilized with bite-actuated mouthpieces 10 are disclosed in U.S. Pat. Nos. 8,177,097, 6,908,015 and 6,675,998, and in U.S. Patent Application Publication Nos. 2004/0089301 and 2006/0231561, the disclosures of which are hereby incorporated by reference.

Although not required to all embodiments, bite-actuated mouthpieces 10 may be a separable component of a drink vessel 13, such that the bite-actuated mouthpiece may be selectively removed from the remainder of the drink vessel, such as for cleaning or replacement of the mouthpiece, without damage or destruction of the mouthpiece or the drink vessel. In other embodiments, bite-actuated mouthpiece 10 may be permanently connected to a remainder of a drink vessel or upstream component thereof (such as to a cap assembly 18 of a drink container 12) in a manner that the bite-actuated mouthpiece may not be removed from the upstream component without damage or destruction of at least a portion of the bite-actuated mouthpiece or the upstream component.

As mentioned, and as their name implies, bite-actuated mouthpieces 10 are configured to dispense drink liquid to a user's mouth upon receipt of user-applied compressive forces to the bite-actuated mouthpieces 10. More specifically, a bite-actuated mouthpiece 10 is configured to dispense drink liquid to a user's mouth upon receipt of user-applied compressive forces to opposing surfaces of the one or more sidewalls 38 to operatively open and unseal the self-sealing exit 42 to permit drink liquid to flow through the self-sealing exit 42. For example, when the self-sealing exit 42 includes a slit 44, opposing faces of the slit 44 are configured to spread apart to permit drink liquid to flow through the slit 44. When no compressive forces are applied to the opposing surfaces of the one or more sidewalls 38, the self-sealing exit 42 is configured to automatically prevent, or at least restrict, the flow of drink liquid through the self-sealing exit 42. Stated differently, a bite-actuated mouthpiece 10 and the self-sealing exit 42 thereof may be described as having a closed, or sealed, configuration, in which the self-sealing exit is closed and drink liquid is prevented, or at least restricted, from flowing through the self-sealing exit 42, and an open, or dispensing, configuration, in which the self-sealing exit is open and drink liquid is permitted to flow through the self-sealing exit 42.

With reference to FIG. 2, in some examples, the bite-actuated mouthpiece 10 is configured to be operatively coupled to the cap assembly 18 or other component of a drink container 12 via a drink spout 20. Drink spout 20, when present, may extend in a fixed, or predefined, orientation with respect to a cap base 19 of the cap assembly 18, or the drink spout may be selectively moved, such as pivoted, within a range of positions relative to the liquid vessel to which the cap assembly is coupled, as schematically illustrated in dashed lines in FIG. 2. As schematically represented in FIG. 2, a bite-actuated mouthpiece 10 may be configured to operatively receive, or to be operatively received by, at least a portion of a drink spout 20 for securing the bite-actuated mouthpiece 10 to a respective drink container 12 or cap assembly 18 thereof. Similarly, with reference to FIG. 3, a bite-actuated mouthpiece 10 may be configured to operatively receive, or to be operatively received by, at least a portion of an upstream component of a hydration system 14, such as an elongate drink tube 30, a quick-release assembly, an on-off valve, pump, filter, flowmeter, or some other mount or additional component 35 of the hydration system.

In such examples, and as schematically represented in FIG. 1, the bite-actuated mouthpiece 10 may include and/or define a mount volume 22 that is sized and shaped to receive, or be received by, and mate with such an upstream component of a drink vessel 13 to establish a water-tight seal that fluidly couples the bite-actuated mouthpiece 10 to the upstream component of the drink vessel. The mount volume 22 may be defined by any suitable interior or exterior surface(s) of the bite-actuated mouthpiece, such as the interior or exterior surface of the bite-actuated mouthpiece proximate inlet 39. Thus, the upstream component of the drink vessel may be received into the mount volume when the mount volume is defined by an internal surface of the bite-actuated mouthpiece. Alternatively, when the mount volume is defined by an external surface of the bite-actuated mouthpiece, the barrel section 58, or other upstream component or region, of the bite-actuated mouthpiece may be at least partially received into the upstream component of the drink vessel.

As shown on the left side of the schematically represented bite-actuated mouthpieces 10 of FIG. 1, some bite-actuated mouthpieces 10 may include an inner wall 78 that extends circumferentially around an inner, or interior, surface 77 of the barrel section 58, that projects into the internal volume 40 from the sidewall(s) 38, and/or that delineates the mount volume 22 from a sub-volume 76 that is proximal to the dispensing wall 36. An inner wall 78, when present, additionally or alternatively may be described or referred to as an internal flange, lip, ledge, or stop. When present, the inner wall 78 may provide structure for engagement with an upstream component of a drink vessel, such as to limit the extent to which the upstream component may be inserted into the mouthpiece and/or to prevent the upstream component of the drink vessel from entering the sub-volume 76 and thus from potentially interfering with the flow of drink liquid through the sub-volume 76 and the operation of the self-sealing exit 42.

Additionally or alternatively, and as also shown on the left side of the schematically represented bite-actuated mouthpieces 10 of FIG. 1, some bite-actuated mouthpieces 10 include a base wall 82 that extends circumferentially around an interior surface of the barrel section 58, that extends into the internal volume 40, and that at least partially defines the internal volume 40 at the inlet 39 of the bite-actuated mouthpiece. The base wall 82 additionally or alternatively may be described or referred to as an inlet flange, lip, ledge, or catch. In examples of bite-actuated mouthpieces 10 that include both an inner wall 78 and a base wall 82, the mount volume 22 may be defined between the inner wall 78 and the base wall 82 and thereby may be sized and shaped to receive a corresponding structure of an upstream component of a drink vessel 13. Examples of such cap assemblies are disclosed in U.S. Pat. No. 8,191,727, incorporated herein.

Additionally or alternatively, and as also shown on the left side of the schematically represented bite-actuated mouthpieces 10 of FIG. 1, some bite-actuated mouthpieces 10 include a crimp tube 25 that extends in an upstream direction from the barrel section of the mouthpiece. When present, crimp tube 25 is configured to be operatively and selectively crimped and uncrimped (e.g., by a structure of a drink vessel 13), such that an on/off valve is defined that is distinct from the self-sealing exit 42 of the bite-actuated mouthpiece. In some examples, the bite-actuated mouthpiece further may include an anchor structure 24, or anchor 25, that is connected to the crimp tube distal the barrel section. Anchor structure 24, when present, may be configured to mechanically couple with a cap assembly 18 or other upstream component of a drink vessel 13 and restrict unintentional removal and/or permit selective removal of the bite-actuated mouthpiece 10 from the upstream component. As an example, the anchor structure 24 may be configured (e.g., sized and shaped) to restrict the bite-actuated mouthpiece 10 from passing through a through-passage of an upstream component of a drink container 12, such as of a cap assembly 18 thereof, or of a component 35 of a hydration system 14. In some examples, at least two of the barrel section, the anchor structure, and the crimp tube may be constructed of a single monolithic body of a resilient material. In some examples, all three of the barrel section, the anchor structure, and the crimp tube may be constructed of a single monolithic body of a resilient material. Moreover, as discussed, the barrel section and the dispensing wall, which collectively may be referred to as a mouthpiece portion, may be constructed of a single monolithic body of a resilient material.

As schematically and optionally represented on the left side of FIG. 1, the body 34 of some bite-actuated mouthpieces 10 additionally includes a flange 72 that extends from the barrel section 58 of the body 34 and away from the internal volume 40. In some such examples, when present, the flange 72 extends from the barrel section 58 generally at a terminal end region of the barrel section 58 opposite/distal the dispensing wall 36; however, such a location for a flange 72, when present, is not required in all examples of bite-actuated mouthpieces 10 that have a flange 72. In some examples, the flange extends from less than 60% of a perimeter of the barrel section, such that it does not fully circumferentially extend around the barrel section. When present, flange 72 may provide structure for engagement with another component of a drink vessel 13 (e.g., a drink spout, a mount, a quick-release assembly, an on-off valve, etc.). Additionally or alternatively, a flange 72 may provide structure for grasping by a user, such as for operative removal of the bite-actuated mouthpiece 10 from another component of a drink container 12 and/or a hydration system 14. Further additionally or alternatively, a flange 72 may provide an engagement surface, such as for a user's thumb, for operative movement of the bite-actuated mouthpiece 10 when installed on a corresponding cap assembly 18, such as one that is configured to permit a user to operatively pivot the bite-actuated mouthpiece 10 between a stowed position and a dispensing position. Examples of corresponding cap assemblies 18 are disclosed in U.S. Pat. No. 7,533,783, incorporated herein. In some embodiments, flange 72 may be formed from a resilient material, such as silicone, that provides greater friction and/or tactile feedback than an underlying rigid (i.e., metal or plastic) drink spout that supports the flange and mouthpiece. In some such examples, the flange may be integral, or monolithic, with the body of the mouthpiece.

As also schematically and optionally represented on the left side of FIG. 1, some mouthpieces 10 include and/or define a restrictive structure 74 that is configured to engage with and/or mate with a corresponding structure of a drink vessel 13, such as to restrict rotation of the mouthpiece 10 relative to the corresponding structure. As an example, the restrictive structure 74 may be or include a channel extending into, or defined by, the flange 72.

As another example, the restrictive structure 74 may be or include a rib or other projection extending from, or defined by, the flange. Other examples of restrictive structure 74 may be incorporated in a flange 72 and/or in another portion of a bite-actuated mouthpiece 10. As another example, a base portion 73 of barrel section 58 and/or inlet 39 may have a contoured, non-circular, stepped, irregular, undulating, or non-symmetrical shape that restricts relative rotation of the mouthpiece 10 with respect to the component of the drink container 12 or hydration system that receives or is received by the mouthpiece.

Additionally or alternatively, in some examples, as schematically and optionally represented on the right side of FIG. 1, some bite-actuated mouthpieces 10 include retention structure 80 that is configured to engage, or mate, with corresponding structure of a component of a drink vessel 13, such as to restrict unintentional removal, or separation, of the mouthpiece from the corresponding structure of the component of a drink vessel 13. In some such examples, when present, the retention structure 80 may extend into the body 34 from an outer surface thereof, such as in the form of a depression, a channel, a groove, a hole, a slot, or other void that is sized and shaped to operatively receive the corresponding structure of the component of a drink vessel 13. In other such examples, when present, the retention structure 80 may extend away from directly adjacent portions of the body 34 of the bite-actuated mouthpiece 10. As an example, an optional retention structure 80 may be configured to mate with a collar that is a component of a drink vessel 13, such as a cap assembly 18 of a drink container or an additional component 35 of a hydration system 14. Anchor structure 24, when present, additionally or alternatively may be described as an example of retention structure 80, and vice versa.

Additionally or alternatively, and as also shown on the right side of FIG. 1, some bite-actuated mouthpieces 10 include barrel section 58 that includes a neck region 81 that defines inlet 39 and which has a smaller cross-sectional area than a downstream portion of the barrel section. Such a smaller neck region may be shaped and/or sized to receive or be received by an upstream component of a drink vessel 13, such as a drink spout 20 of a drink container 12 or a drink tube 30, quick-release assembly, on/off valve, or other component 35 of a hydration system 14. In some embodiments, having a larger transverse cross-sectional area in barrel section 58 downstream of neck region 81 may promote continuous and steady dispensing of drink liquid from the mouthpiece.

Additionally or alternatively, and as also shown on the right side of FIG. 1, some bite-actuated mouthpieces 10 include an exterior sleeve 83 that extends outwardly from the sidewalls 38 of the mouthpiece to define a channel, or passage, 85 into which an upstream component of a drink vessel 13, such as a drink spout 20 of a drink container 12 or a drink tube 30 or other component 35 of a hydration system 14, may be inserted. When present, sleeve 83 may provide additional support and/or frictional retention of the mouthpiece to the upstream component of the drink vessel. Sleeve 83 additionally or alternatively may be referred to as a collar and/or a cuff.

Turning next to the schematic representations of examples of bite-actuated mouthpieces 10 illustrated in FIGS. 4-8, bite-actuated mouthpieces 10 may be described as, or characterized as, having a longitudinal, or flow, axis 48 that extends through the internal volume 40 of the bite-actuated mouthpiece's body 34 and that generally defines the direction of flow of drink liquid from an upstream component of the drink container 12 of hydration system 14, through inlet 39 and internal volume 40, to the dispensing wall 36, and through the self-sealing exit 42. In some examples, the longitudinal axis 48 extends through the geometric center of cross-sections of the body 34 that are perpendicular to the longitudinal axis 48.

Figure 4:
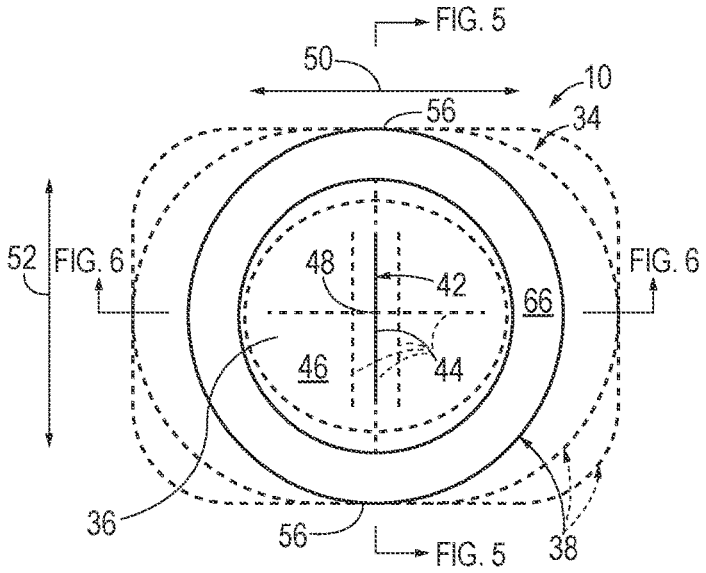
FIG. 4 is a schematic end view representation of examples of bite-actuated mouthpieces according to the present disclosure.
Figure 5:
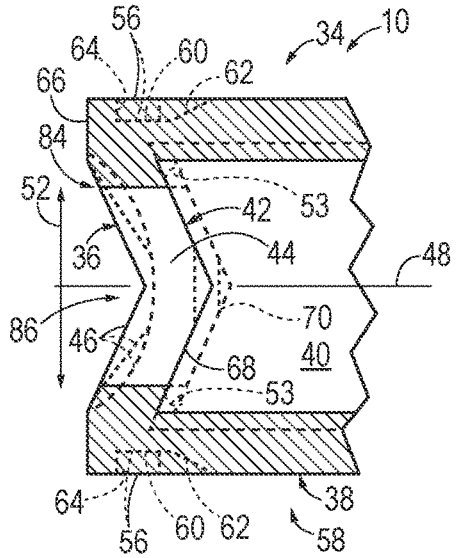
FIG. 5 is a schematic cross-sectional side representation of examples of bite-actuated mouthpieces according to the present disclosure, taken along line 5-5 of FIG. 4.

Bite-actuated mouthpieces 10 also may be described as, or characterized as, having a first lateral dimension, or axis, 50 and a second lateral dimension, or axis, 52 that is perpendicular to the first lateral dimension 50. As schematically represented in FIGS. 4 and 5, in examples of bite-actuated mouthpieces 10 with a self-sealing exit 42 that includes at least one slit 44, the first lateral dimension 50 may be perpendicular to the slit 44, and the second lateral dimension 52 may be parallel to the slit 44. As schematically represented in solid lines in FIGS. 2-8, in some bite-actuated mouthpieces 10, a maximum width of the body 34 in the first lateral dimension 50 may be equal or generally equal to a maximum width of the body 34 in the second lateral dimension 52 at least at the dispensing wall 36 (e.g., at the circumferential lip 66 of the sidewall(s) 38) and/or at one or more perpendicular cross-sections of the body 34 relative to the longitudinal axis 48, such as in an example where the outer surface of the body is circular at the perpendicular cross-sections thereof. That said, the body 34 of a bite-actuated mouthpiece 10 is not required to be uniform in shape along an entirety of the longitudinal axis 48 thereof. For example, and as schematically and optionally represented in FIG. 4, in other bite-actuated mouthpieces 10, a maximum width of the body 34 in the first lateral dimension 50 may be greater than a maximum width of the body 34 in the second lateral dimension 52 at the dispensing wall 36 or at one or more perpendicular cross-sections thereof relative to the longitudinal axis 48, such as in optional examples in which the outer surface of the body 34 is elliptical, ovular, or otherwise oblong in the first lateral dimension 50. In some such examples, such as corresponding to the outer-most schematic representation in dashed lines in FIG. 4, the outer surface of the body 34 at one or more perpendicular cross-sections thereof relative to the longitudinal axis 48 may be described as being generally rectangular with curved, bull-nosed, or soft, corners.

As examples, a maximum width of the body 34 (optionally at the dispensing wall 36 thereof) in the first lateral dimension 50 and/or in the second lateral dimension 52 may be at least 10 millimeters (mm), at least 20 mm, at least 25 mm, at least 30 mm, at most 40 mm, at most 35 mm, at most 30 mm, at most 25 mm, at most 20 mm, in the range of 10-30 mm, in the range of 10-25 mm, in the range of 10-20 mm, in the range of 10-15 mm, in the range of 15-30 mm, in the range of 15-25 mm, in the range of 15-20 mm, in the range of 20-30 mm, in the range of 20-25 mm, and/or in the range of 25-30 mm. Widths outside of these ranges also are within the scope of the present disclosure. As discussed, the maximum width of the body in the first lateral dimension 50 may be equal, or substantially equal, to the maximum width of the body at the second lateral dimension 52, or one of the maximum widths may be greater than the other of the maximum widths. As examples, one of the maximum widths may be at least 5%, at least 10%, at least 20%, at least 25%, at least 30%, at least 50%, or at least 50% greater than the other of the maximum widths.

Additionally or alternatively, and as also schematically represented in solid lines in FIGS. 4-8, in some bite-actuated mouthpieces 10, the one or more sidewalls 38 may have a uniform or generally uniform thickness (which may be referred to as the sidewall thickness) at one or more cross-sections thereof that are perpendicular to the longitudinal axis 48. However, as schematically and optionally represented in dashed lines in FIG. 4, in other bite-actuated mouthpieces 10, the sidewall thickness at one or more perpendicular cross-sections of the body may not be uniform (i.e., may vary), such as with the outer surface being circular and the interior surface being planar or otherwise non-circular, with the outer surface being non-circular and the interior surface being circular, or with the interior surface and the exterior surface both being non-circular and non-parallel to each other. In some examples, at one or more cross-sections that are perpendicular to the longitudinal axis 48, the sidewall thickness is greater in the first lateral dimension than in the second lateral dimension. Such a configuration may reduce the bite force required to reconfigure the self-sealing exit from the closed configuration to the open configuration.

Figure 8:
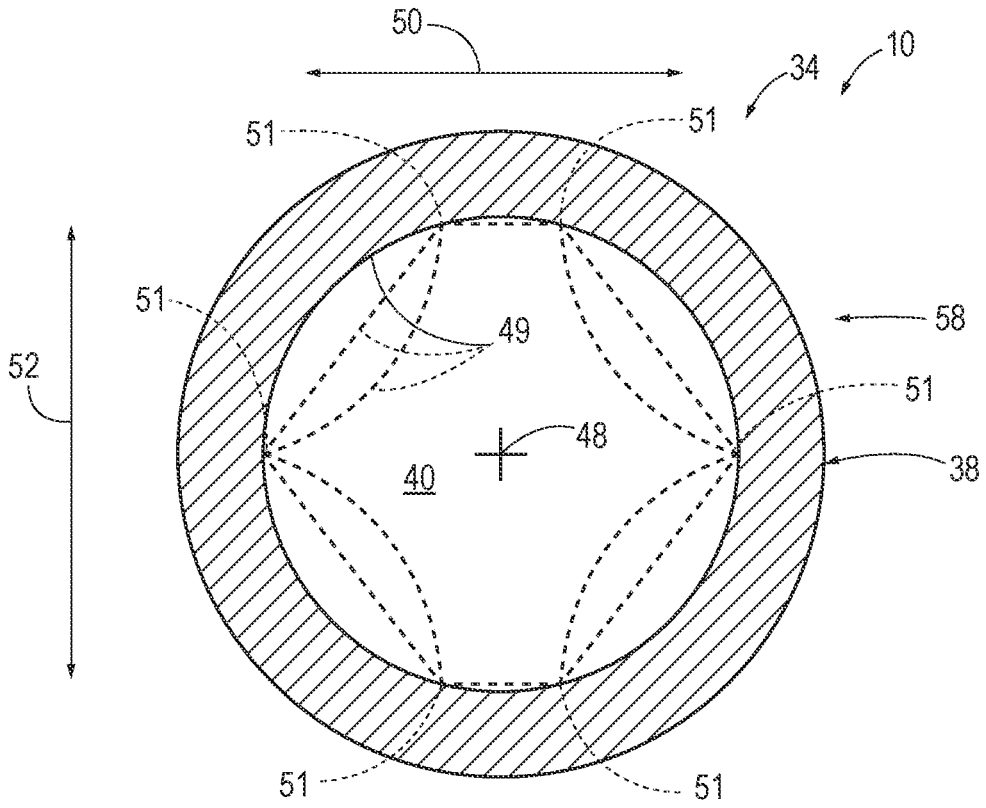
FIG. 8 is a schematic cross-sectional end representation of examples of bite-actuated mouthpieces according to the present disclosure, taken along line 8-8 of FIG. 6.
Figure 9:
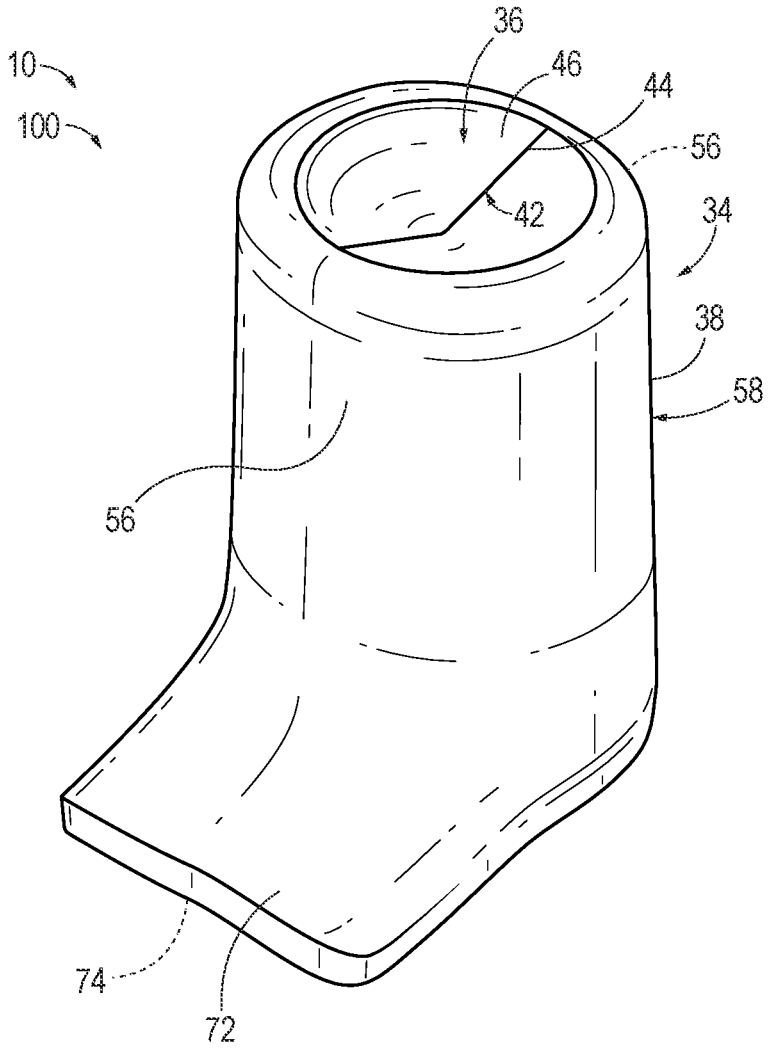
FIG. 9 is a perspective view of an example of a bite-actuated mouthpiece according to the present disclosure.
Figure 10:
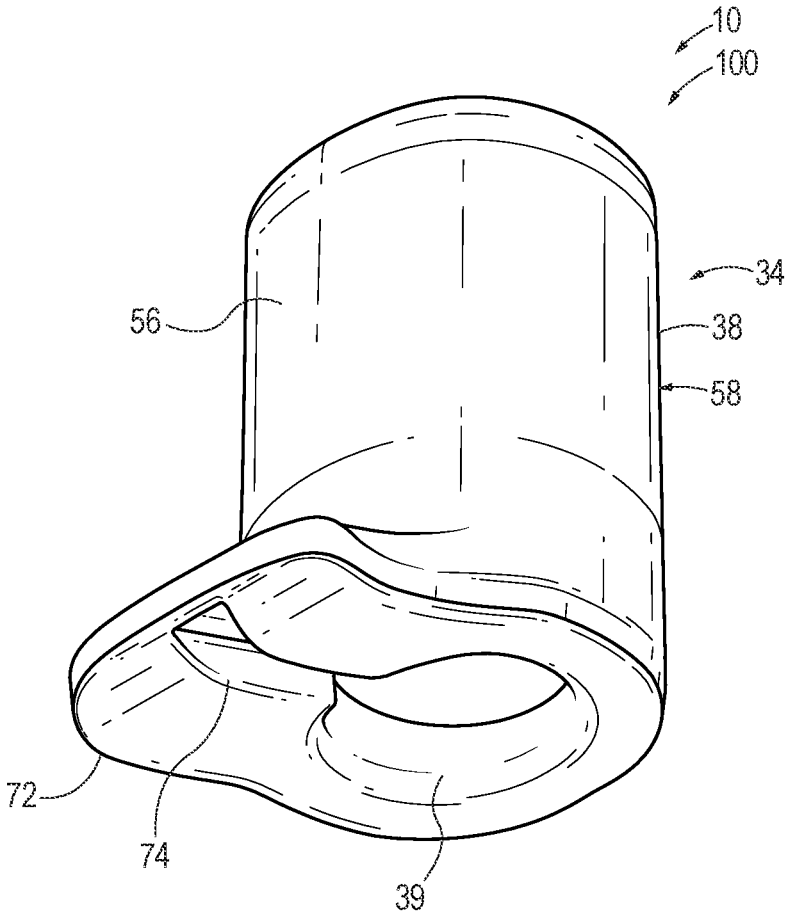
FIG. 10 is another perspective view of the bite-actuated mouthpiece of FIG. 9.

In some such examples, as schematically and optionally represented in FIG. 8, the interior surface 49 of the body 34 may have three or more apexes 51 between adjacent surface regions at one or more perpendicular cross-sections of the body 34 relative to the longitudinal axis 48. For example, at such perpendicular cross-sections, the interior surface 49 of the body 34 may be polygonal or generally polygonal with flat or generally flat sides, such as in the schematic example of a hexagon in FIG. 8. Additionally or alternatively, at such perpendicular cross-sections, the interior surface of the body 34 may have curved sides between adjacent apexes, such as in the schematic example of four such sides in FIG. 8. Additionally or alternatively, at such perpendicular cross-sections, the interior surface of the body 34 may have one or more flat surfaces between adjacent apexes and one or more curved surfaces between other adjacent apexes, such as schematically represented with the four curved surfaces in combination with two flat surfaces in FIG. 8. In some such examples, the flat surfaces may extend in the first lateral dimension 50 and may be parallel to, or generally parallel to, opposing bite regions 56 of the outer surface of the body 34.

A particular configuration may be selected to optimize such factors as the force required to be imparted to the opposed bite regions of a mouthpiece to operatively reconfigure the self-sealing exit to the open configuration, the internal bias of the mouthpiece to return the seal-sealing exit to the closed configuration, the operative sealing of the self-sealing exit (i.e., prevention of leaking), etc.

Bite regions 56 additionally or alternatively may be referred to as bite surfaces 56. As examples, a thickness of one or more sidewalls 38 of the body 34 may be in a range of and/or may vary within a range of 1-5 mm, 1-4 mm, 1-3 mm, 1-2 mm, 2-5 mm, 2-4 mm, 2-3 mm, 3-5 mm, 3-4 mm, or 4-5 mm. Thicknesses outside of these ranges also are within the scope of the present disclosure.

Figure 6:
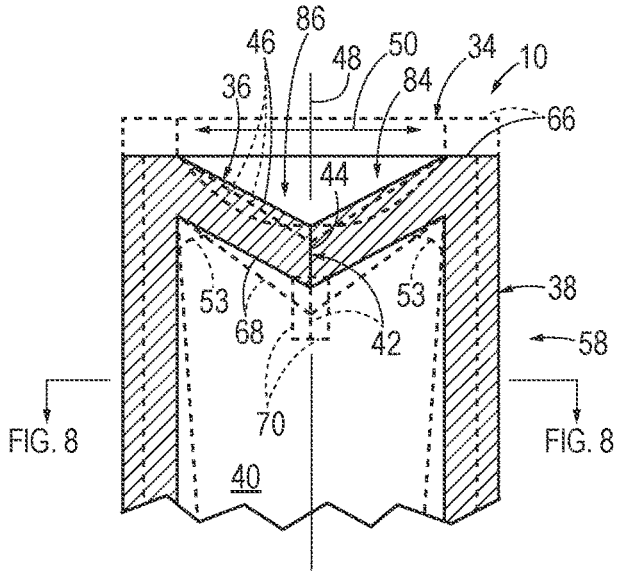
FIG. 6 is another schematic cross-sectional side representation of examples of bite-actuated mouthpieces according to the present disclosure, taken along line 6-6 of FIG. 4.
Figure 7:
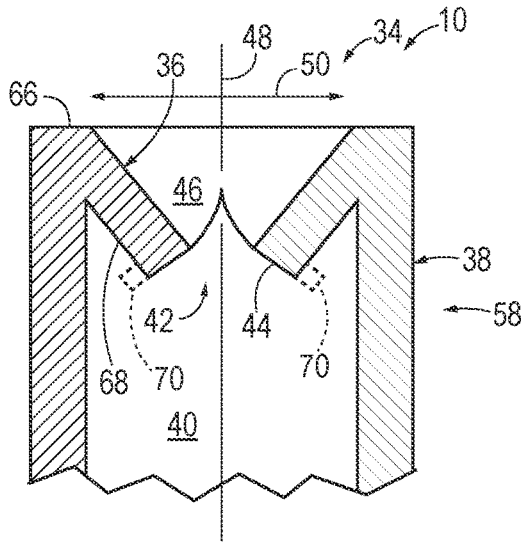
FIG. 7 is another schematic side representation of examples of bite-actuated mouthpieces according to the present disclosure, corresponding to the view of FIG. 6, but with the mouthpieces represented in an open configuration.

Additionally or alternatively, and as schematically represented in solid lines in FIGS. 5 and 6, in some bite-actuated mouthpieces 10, the one or more sidewalls 38 may have a uniform sidewall thickness along the longitudinal axis at one or more cross-sections that contain the longitudinal axis 48. However, as schematically and optionally represented in dashed lines in FIG. 5, the sidewall thickness may vary along the longitudinal axis 48 at one or more cross-sections that contain the longitudinal axis 48, for example, with the thickness increasing away from the dispensing wall 36 and the circumferential lip 66 and toward the inlet 39, as represented in dashed lines in FIG. 6. Alternatively, the thickness may decrease away from the dispensing wall and the circumferential lip and toward the inlet. As examples, a thickness of the one or more sidewalls 38 may vary in thickness by at least 5%, at least 10%, at least 20%, at least 25%, 5-20%, 10-15%, 1-10%, 1-8%, 1-6%, 1-4%, 1-2%, 2-10%, 2-8%, 2-6%, 2-4%, 4-10%, 4-8%, 4-6%, 6-10%, 6-8%, or 8-10% over the length (i.e., in the direction of the longitudinal axis 48) of the one or more sidewalls 38. Percentages outside of these ranges also are within the scope of the present disclosure.

Additional examples of other internal geometries for body 34 are disclosed in U.S. Pat. No. 6,032,831, the disclosure of which is incorporated by reference. The preceding discussion about the thickness and/or internal geometries of body 34 additionally or alternatively may apply to only a portion of body 34, such as to all or a portion of barrel section 58 of body 34.

With reference to FIGS. 4 and 5, the one or more sidewalls 38 of the body 34 of bite-actuated mouthpieces 10 comprise opposing bite regions 56 positioned to receive user-applied compressive forces thereto to operatively open and unseal the self-sealing exit 42 (i.e., to reconfigure it from the closed configuration to the open configuration) to permit drink liquid to flow through the self-sealing exit 42. In some examples, opposing bite regions 56 may include planar, generally planar, flat, or generally flat regions, such as in examples where the outer surface of the body 34 is ovular, generally rectangular, or otherwise oblong. In examples of bite-actuated mouthpieces 10 whose self-sealing exit 42 includes a slit 44, the opposing bite regions 56 are positioned on opposite sides of the terminal ends of at least one slit 44. Stated differently, the opposing bite regions 56 may be perpendicular, or transverse, to at least one slit 44 and generally extend in the direction of the first lateral dimension 50 and transverse to the second lateral dimension 52.

As schematically and optionally represented in FIG. 5, in some bite-actuated mouthpieces 10, the body 34 defines opposing recesses 60 in body 34 that at least partially define the opposing bite regions 56 and that are sized and positioned to receive a user's upper and lower incisors for application of a compressive force to operatively open and unseal the self-sealing exit 42, as well as to permit a user to more easily retain the bite-actuated mouthpiece 10 between the user's upper and lower incisors without applying a compressive force thereto. In some such examples, as schematically and optionally represented in FIG. 5, the opposing recesses 60 each may have a ramped face, or ramped surface, 62 extending from the respective bite regions 56 at an obtuse angle in a direction away from the dispensing wall 36. When present, such a ramped face 62 may facilitate a user locating the respective bite regions 56 with the user's corresponding incisors.

Additionally or alternatively, as also schematically and optionally represented in FIG. 5, the opposing recesses 60 each may have a ledge surface 64 extending perpendicular, generally perpendicular, and/or substantially perpendicular from the respective bite regions 56 on a side of the bite regions 56 toward the dispensing face 46, and opposite the optional ramped surface 62, when present. When present, such a ledge surface 64 may facilitate a user maintaining the body 34 of the bite-actuated mouthpiece 10 between the user's incisors, because the user's incisors will engage the ledge surfaces 64 and restrict the movement of the bite-actuated mouthpiece 10 away from the user's mouth. Opposing recesses 60 additionally or alternatively may be described or referred to as bite locators.

With reference to FIGS. 4-7, the dispensing face 46 of some bite-actuated mouthpieces 10 may be concave. For example, the terminal end(s) of the one or more sidewalls 38 may define a circumferential lip 66 that defines a distal-most (i.e., downstream-most) surface of the body 34 relative to the inlet 39, and the dispensing face 46 may extend from the lip 66 toward the internal volume 40 and/or inlet 39 of the mouthpiece 10. In some such examples, the dispensing face 46 extends generally from the lip 66 into the internal volume 40 and/or toward inlet 39. In other examples, as optionally represented in FIG. 6, the circumferential lip may extend beyond the dispensing wall 36 relative to the internal volume 40.

As examples, the interior surface 68 of the dispensing wall 36 that defines and/or faces the internal volume 40 may extend from the one or more sidewalls 38 at an angle of at least 45°, at least 55°, at least 60°, at least 65°, at least 70°, at least 75°, at least 80°, at most 90°, at most 85°, at most 80°, at most 75°, at most 70°, in a range of 45-90°, in a range of 45-80°, in a range of 45-70°, in a range of 45-60°, in a range of 60-90°, in a range of 60-80°, in a range of 60-70°, in a range of 70-90°, in a range of 70-80°, and/or in a range of 80-90°. Having a concave dispensing face 46 may provide for one or more of a greater flow rate of drink liquid through the self-sealing exit, a decreased magnitude of compressive forces to transition the mouthpiece to and/or maintain the mouthpiece in the open configuration, a greater resistance to dispensing of drink liquid due to backpressure (i.e., pressure applied against the interior surface 68 of the dispensing wall 36, such as responsive to increased pressure within the internal volume 40), and/or an increased exit size, as compared to an otherwise identical mouthpiece having a planar or convex dispensing face. The degree of change in one or more of these properties may be at least 5%, at least 10%, at least 15%, at least 20%, at least 25%, at least 35%, at least 45%, at least 50%, and/or at least 75%.

The angle at which the interior surface 68 of the dispensing wall 36 that faces the internal volume 40 extends from the one or more sidewalls 38 may be constant around the entire interior surface of the dispensing wall, or it may vary. When the angle is not constant, it may vary periodically around the entire inner surface of the dispensing wall, such as by being greater or smaller at regions of the inner surface that are parallel and/or transverse to at least one slit of the exit.

The radius of curvature at a transition 53 between the one or more sidewalls 38 and the dispensing wall 36 on the inside of the barrel section 58 (i.e., between the sidewall(s) 38 and the interior surface 68 of the dispensing wall 36) may be generally uniform around the internal volume 40. In other examples, however, the radius of curvature at the transition 53 may vary, periodically change, and/or not be constant around the internal volume 40. In some examples of bite-actuated mouthpieces 10, such a radius of curvature may be smaller along spans of the transition that are transverse to the slit 44 (FIG. 6), when the self-sealing exit 42 comprises a slit 44, than along spans of the transition that are parallel to the slit (FIG. 5). Stated differently, in some examples, the radius of curvature of the transition 53 at a first cross-section of the body that contains the longitudinal axis and that is in the first lateral dimension 50 may be greater than at a second cross-section of the body that contains the longitudinal axis and that is in the second lateral dimension 52. In some such examples, the radius of curvature may be smaller closer to the self-sealing exit 42 than away from the self-sealing exit. Such configurations may be advantageous so that a user-applied compressive force on the opposing bite regions 56 is more directly transferred to the dispensing wall 36 for operative unsealing of the self-sealing exit 42 and spreading of the slit 44 for dispensing drink liquid therethrough. As examples, the radius of curvature at a transition 53 between the one or more sidewalls 38 and the dispensing wall 36 on the inside of the barrel section 58 may be within a range of and/or vary within a range of 0.05-1°, 0.05-0.8°, 0.05-0.6°, 0.05-0.4°, 0.05-0.2°, 0.05-0.1°, 0.1-1°, 0.1-0.8°, 0.1-0.6°, 0.1-0.4°, 0.1-0.2°, 0.2-1°, 0.2-0.8°, 0.2-0.6°, 0.2-0.4°, 0.4-1°, 0.4-0.8°, 0.4-0.6°, 0.6-1°, 0.6-0.8°, or 0.8-1°. Radii outside of these ranges also are with the scope of the present disclosure.

As schematically represented in solid lines in FIGS. 5 and 6, the dispensing wall 36 may have a generally uniform thickness, which may be referred to as a dispensing-wall thickness; however, as schematically and optionally represented in dashed lines in FIGS. 5 and 6, the thickness of the dispensing wall 36 may not be uniform. For example, the thickness of the dispensing wall 36 may increase toward the self-sealing exit 42 and/or toward the longitudinal axis 48 relative to (i.e., away from) the sidewall(s) 38, as schematically and optionally represented in FIGS. 5 and 6. Having an increased thickness of the dispensing wall at or proximate the self-sealing exit 42 may promote a stronger liquid seal of the self-sealing exit, as compared to an otherwise identical mouthpiece with a thinner dispensing wall at or proximate the slit 44. In other examples, the thickness of the dispensing wall 36 may decrease toward the self-sealing exit 42 and/or toward the longitudinal axis 48 relative to (i.e., away from) the sidewall(s) 38, as also schematically and optionally represented in FIGS. 5 and 6. Having a decreased thickness proximate the self-sealing exit may provide for a lower bite force required to transition the self-sealing exit from the closed configuration to the open configuration. As examples, a thickness of the dispensing wall 36 of the body 34 may be in a range of and/or may vary within a range of 1-5 mm, 1-4 mm, 1-3 mm, 1-2 mm, 2-5 mm, 2-4 mm, 2-3 mm, 3-5 mm, 3-4 mm, or 4-5 mm. Additionally, a thickness of the dispensing wall may vary in thickness by 1-10%, 1-8%, 1-6%, 1-4%, 1-2%, 2-10%, 2-8%, 2-6%, 2-4%, 4-10%, 4-8%, 4-6%, 6-10%, 6-8%, or 8-10% across the dispensing wall 36, such as from adjacent the lip 66 toward the self-sealing exit 42. Thicknesses and percentages outside of these ranges also are within the scope of the present disclosure.

At one or more cross-sections of the body 34 that contain the longitudinal axis 48, the dispensing face 46 may be straight, linear, or generally straight or linear, and/or may include straight or linear, or generally straight or linear, regions, as schematically and optionally represented in FIGS. 5 and 6. In some such examples, the dispensing face 46 is linear at least at the cross-sections of the body 34 that contain the longitudinal axis 48 and that is coextensive with the slit 44 (i.e., the cross-section in the second lateral dimension 52 that bisects the dispensing wall 36 at the slit 44 (FIG. 5)). In some such examples, the dispensing face is straight or linear, or generally straight or linear, at all, or substantially all, cross-sections of the body 34 that contain the longitudinal axis 48, in which examples, the dispensing face 46 therefore may be described as being conical, as being generally conical, as being frustoconical or as having a truncated conical shape, or as having one or more conical regions. That said, in such examples, the perimeter of the dispensing face 46 and any perpendicular cross-section thereof relative to the longitudinal axis 48 is not required to be circular. In some examples, the dispensing face is V-shaped at one or more cross-sections (and optionally at all cross-sections) of the body that include the longitudinal axis, that is with two straight or linear segments at an angle to each other.

Additionally or alternatively, at one or more cross-sections of the body 34 that contain the longitudinal axis 48, the dispensing face 46 may be arcuate (e.g., parabolic) and/or may include arcuate regions, as also schematically and optionally represented in FIGS. 5 and 6. In some such examples, the dispensing face 46 is arcuate at all, or substantially all, cross-sections of the body 34 that contain the longitudinal axis 48, in which examples, the dispensing face 46 may be described as being bowl-shaped. In some such examples, the dispensing face may have a uniform radius of curvature, while in other such examples, the dispensing face may have a non-uniform radius of curvature.

In some examples, a contour of the dispensing face 46 and a contour of the interior surface 68 of the dispensing wall 36 are parallel to each other, such that the dispensing wall 36 is generally uniform in thickness. In other examples, the contour of the dispensing face 46 differs from the contour of the interior surface 68 (i.e., the dispensing face and the interior surface are non-parallel), such that the dispensing wall 36 is not uniform in thickness. As a more specific example, in some bite-actuated mouthpieces 10, at the cross-section of the body 34 that is coextensive with the slit 44 (e.g., the cross-section in the second lateral dimension 52 that bisects the dispensing wall 36 at the slit 44 (FIG. 5)), the contour of the dispensing face 46 may have linear regions, while at the cross-section of the body 34 that is perpendicular to the slit 44 (e.g., the cross-section in the first lateral dimension that bisects the slit 44 (FIG. 6)), the contour of the dispensing face may have arcuate regions. As another more specific example, in some bite-actuated mouthpieces 10, at the cross-section of the body that is coextensive with the slit 44 (such as shown in FIG. 5) and/or at the cross-section of the body that is perpendicular to the slit 44 (such as shown in FIG. 6), the thickness of the dispensing face may be greater proximate the slit than proximate the sidewalls, with the dispensing face transitioning in linear and/or arcuate spans from the thicker region to the thinner region.

Additionally or alternatively, with reference to FIGS. 5 and 6, the dispensing face 46 may be described as having an outer region 84 that is proximate to the sidewall(s) 38 and an inner region 86 that is positioned radially inward relative to the outer region 84 (i.e., closer to and encompassing the longitudinal axis 48). In some examples, the outer region is conical (i.e., straight at cross-sections that include the longitudinal axis) and the inner region is bowl-shaped (i.e., arcuate or parabolic at cross-sections that include the longitudinal axis). In some examples, at all cross-sections containing the longitudinal axis, the dispensing face is straight within the outer region and arcuate or parabolic within the inner region. In other examples, the outer region is bowl-shaped (i.e., arcuate or parabolic at cross-sections containing the longitudinal axis) and the inner region is planar, such that the inner region may be described as a flat bottom of the dispensing face 46. In other examples, at one or more cross-sections (optionally at all cross-sections) containing the longitudinal axis, the dispensing face is straight within the outer region and straight within the inner region, while still being concave overall. In some such examples, the dispensing face is perpendicular to the longitudinal axis within the inner region, again such that the inner region may be described as a flat bottom of the dispensing face. In yet other examples, at one or more cross-sections (optionally at all cross-sections) containing the longitudinal axis, the dispensing face is arcuate or parabolic within the outer region and straight within the inner region. In some such examples, the dispensing face is perpendicular to the longitudinal axis within the inner region, again such that the inner region may be described as a flat bottom of the dispensing face. Other configurations also are within the scope of the present disclosure, and a particular configuration may be selected to optimize such factors as the force required to be imparted to the opposed bite regions of a mouthpiece to operatively reconfigure the self-sealing exit to the open configuration, the internal bias of the mouthpiece to return the seal-sealing exit to the closed configuration, the operative sealing of the self-sealing exit (i.e., prevention of leaking), etc.

As schematically and optionally represented in FIGS. 5 and 6, in some examples of bite-actuated mouthpieces 10 with a self-sealing exit 42 that comprises a slit 44, the dispensing wall 36 is thicker along the slit 44 than spaced apart from the slit. For example, the dispensing wall 36 may include a pair of elongate projections 70 that extend from the interior surface 68 of the dispensing wall 36 at least partially along, and that partially define, the slit 44. These projections 70 additionally or alternatively may be described and/or referred to as lips, slit flanges, or ribs. In some examples, as schematically and optionally represented in FIG. 5, the thicker region, such as defined by the projections 70, may completely span, or at least substantially span, the internal volume 40 in the second lateral dimension 52. In some examples, it may be advantageous for the thicker region to completely span the internal volume so that a user-applied compressive force on the opposing bite regions 56 is more directly transferred to the dispensing wall 36 for operative unsealing of the self-sealing exit 42 and spreading of the slit 44 for dispensing drink liquid therethrough. In other examples, as also schematically and optionally represented in FIG. 6, the projections 70 may not completely span the internal volume 40 in the second lateral dimension 52, and instead may terminate away from the one or more sidewalls 38. In some such examples, the projections 70 may at least substantially span the length of the slit 44.

When present, projections 70 may increase the sealing of self-sealing exit 42 by providing a greater surface area of contact between the opposed surfaces of dispensing face 46 that define slit 44. The projections 70 additionally or alternatively may be described as increasing the minimum compressive force that must be applied by a user to transition the mouthpiece 10 from a closed configuration to an open, or dispensing, configuration and/or as increasing the minimum backpressure that can be applied against the interior surface of the dispensing face to cause unintentional dispensing (i.e., leaking) of drink liquid through the self-sealing exit when user-applied compressive forces are not being applied to the mouthpiece.

As schematically and optionally represented in FIG. 5, in some examples, each of the pair of elongate projections 70 comprises a planar region that is perpendicular to the longitudinal axis 48. In some such examples, the planar region spaces less than an entirety of the respective elongate projection. In some examples, each of the pair of elongate projections comprises three planar regions. These planar regions include first and second planar regions that form the one or more sidewalls 38, and a third planar region that extends between the first and second planar regions. The third planar region optionally may be, or extend, perpendicular to the longitudinal axis 48. In some such examples, the first and second planar regions extend from the one or more sidewalls at an angle of at least 45°. Other configurations of elongate projections are within the scope of the present disclosure, and a particular configuration may be selected to optimize the sealing properties of mouthpieces 10, the flow rate of mouthpieces 10, the required bite forces for reconfiguring the self-sealing exit from the closed configuration to the open configuration, etc.

Additionally or alternatively, and as schematically and optionally represented in FIGS. 5 and 6, the dispensing face 46 and/or the interior surface 68 may include planar, generally planar, or substantially planar regions that are perpendicular, or substantially perpendicular, to the longitudinal axis 48. In some such examples, when present on the dispensing face 46 and/or interior surface 68, such a planar region that is perpendicular to the longitudinal axis may increase the minimum compressive force that must be applied by a user to transition the mouthpiece 10 from a closed configuration to an open, or dispensing, configuration and/or may increase the minimum backpressure that can be applied against the interior surface of the dispensing face to cause unintentional dispensing (i.e., leaking) of drink liquid through the self-sealing exit when user-applied compressive forces are not being applied to the mouthpiece.

As schematically represented in FIGS. 4 and 5, when the self-sealing exit 42 comprises a slit 44, the slit 44 may span less than an entirety of the dispensing wall 36 radially inward from the one or more sidewalls 38 and the lip 66 thereof. As used herein, "radially inward" means toward the longitudinal axis 48 of a mouthpiece 10. However, as schematically and optionally represented in FIGS. 4 and 5, the slit may span, or substantially span, an entirety of the dispensing wall 36 radially inward from the one or more sidewalls 38. In some such examples, having the slit 44 substantially span the entirety of the dispensing wall 36 radially inward from the one or more sidewalls 38 may facilitate a lower user-applied compressive force to the opposing bite regions 56 required to operatively spread the slit 44 for a desired flow rate of drink liquid, when compared to examples where the slit 44 terminates a distance away from the one or more sidewalls 38. As examples, the slit 44 may span 50-100%, 50-90%, 50-80%, 50-70%, 50-60%, 60-100%, 60-90%, 60-80%, 60-70%, 70-100%, 70-90%, 70-80%, 80-100%, 80-90%, or 90-100% of an entirety of the dispensing wall 36 radially inward from the one or more sidewalls 38. Examples of suitable lengths for slit 44 include lengths of at least 8 mm, at least 9 mm, at least 10 mm, at least 11 mm, at least 12 mm, at least 13 mm, at most 20 mm, at most 18 mm, at most 16 mm, at most 14 mm, at most 12 mm, in the range of 8-18 mm, in the range of 9-15 mm, and/or in the range of 10-12 mm. Lengths that are outside of these ranges also are within the scope of the present disclosure.

As discussed, bite-actuated mouthpieces 10 according to the present disclosure may have concave dispensing faces 46 and further may have a self-sealing exit 42 defined by at least one slit 44. A potential benefit of such concave dispensing faces, as compared to otherwise identical bite-actuated mouthpieces that have planar or convex dispensing faces, is that the area of the self-sealing exit at the dispensing face when the bite-actuated mouthpiece is in an open configuration is not obstructed by the remainder of the portions of the dispensing face that define the slit and/or by projections 70, when present, as understood with reference to the schematic representation of bite-actuated mouthpieces 10 in the open configuration in FIG. 7. With a concave dispensing face, the dispensing wall will displace upstream (i.e., will flex toward the internal volume 40), with the size of the opening in self-sealing exit 42 increasing as the magnitude of the user-applied compressive forces increases. In addition, when the self-sealing exit is in the closed configuration, an increase in a liquid pressure within the internal volume 40 will actually increase a sealing force of the self-sealing exit, at least up to a threshold pressure, rather than causing the self-sealing exit to leak. Moreover, in mouthpieces 10 that also include elongate projections 70, the projections will not obstruct or reduce the effective size of the opening in the self-sealing exit when the mouthpiece is in the open configuration, as understood with reference to FIG. 7.

Turning now to FIGS. 9-33, example embodiments of bite-actuated mouthpieces 10 are illustrated, along with examples of drink vessels 13, namely, drink containers 12 and hydration systems 14, that include a bite-actuated mouthpiece 10 according to the present disclosure. Where appropriate, the reference numerals from the schematic illustrations of FIGS. 1-8 are used to designate corresponding parts of the examples of FIGS. 9-33; however, the examples of FIGS. 9-33 are non-exclusive and do not limit bite-actuated mouthpieces 10 to the illustrated embodiments of FIGS. 9-33. That is, bite-actuated mouthpieces 10 are not limited to the specific embodiments of FIGS. 9-33, and bite-actuated mouthpieces 10 may incorporate any number of the various aspects, configurations, characteristics, properties, etc. of bite-actuated mouthpieces 10 that are illustrated in and discussed with reference to the schematic representations of FIGS. 1-8 and/or the embodiments of FIGS. 9-33, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to the examples of FIGS. 9-33; however, it is within the scope of the present disclosure that the previously discussed features, variants, etc. may be utilized with the examples of FIGS. 9-33.

Figure 16:
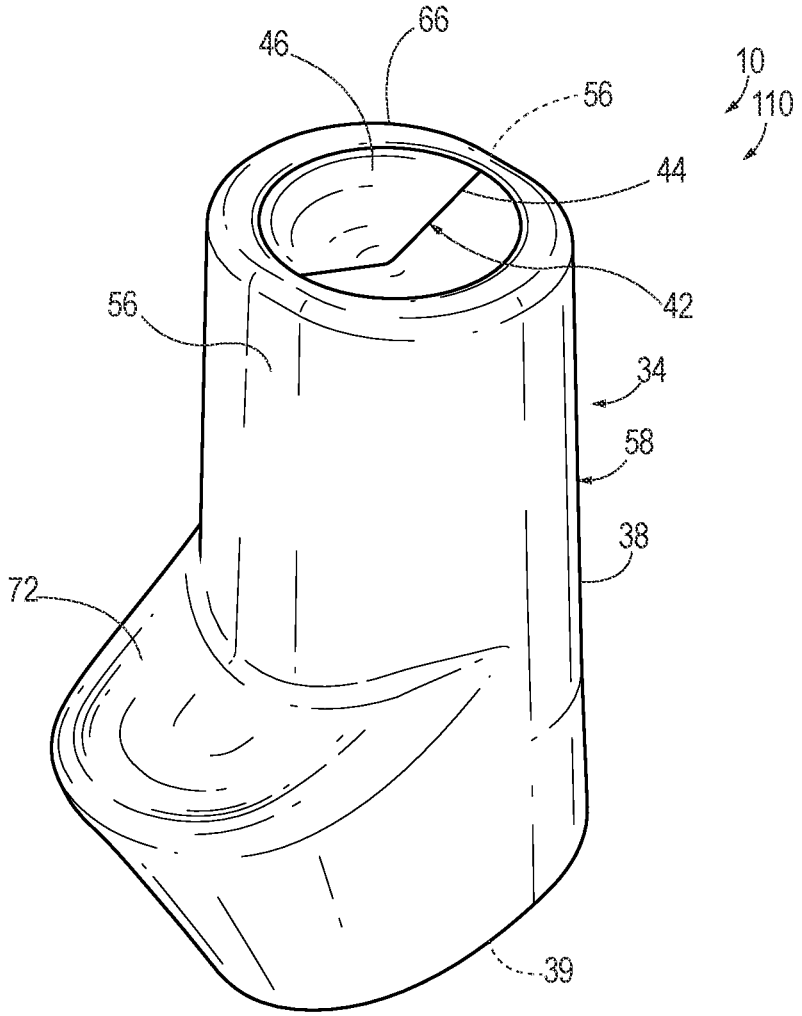
FIG. 16 is a perspective view of another example of a bite-actuated mouthpiece according to the present disclosure.
Figure 18:
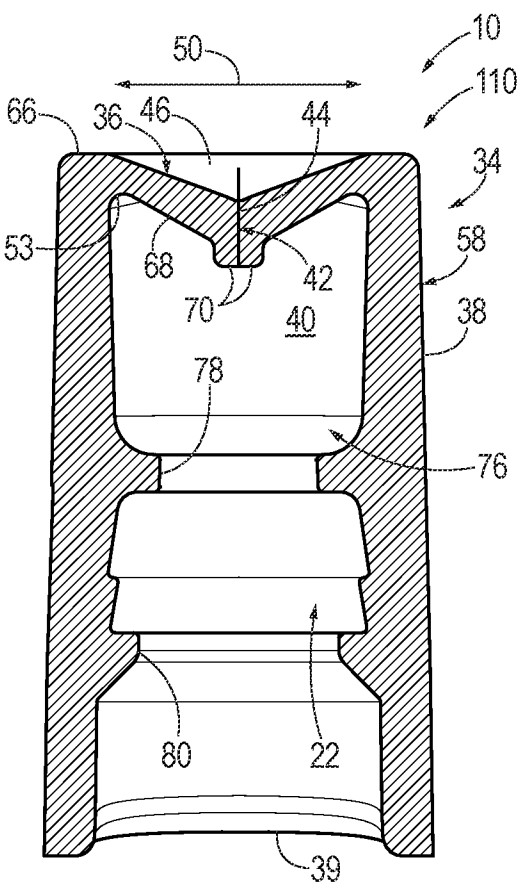
FIG. 18 is another cross-sectional side view of the bite-actuated mouthpiece of FIG. 16.
Figure 17:
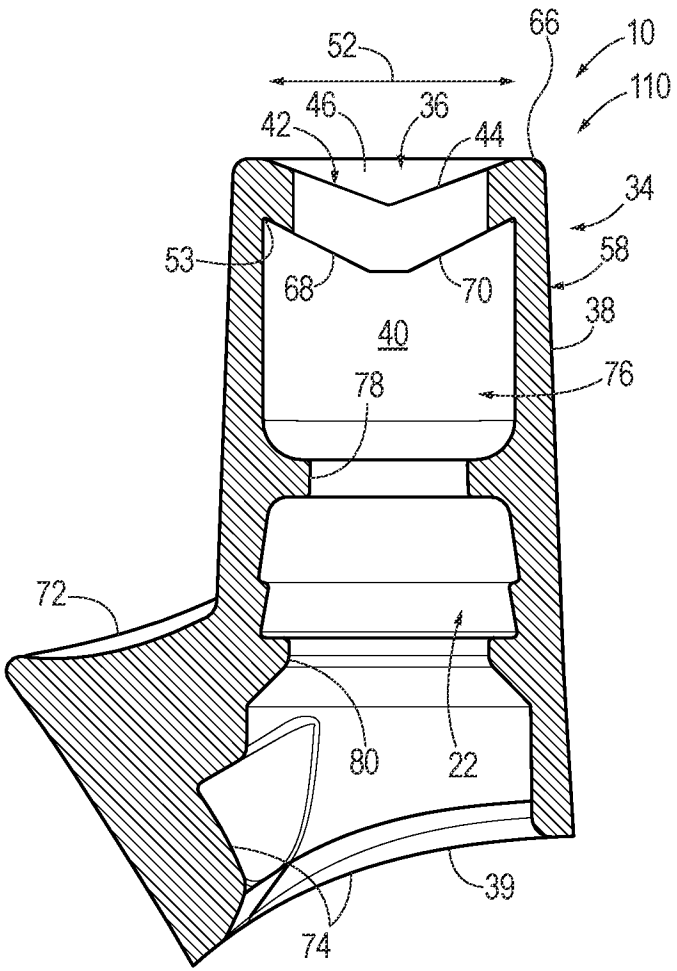
FIG. 17 is a cross-sectional side view of the bite-actuated mouthpiece of FIG. 16.
Figure 19:
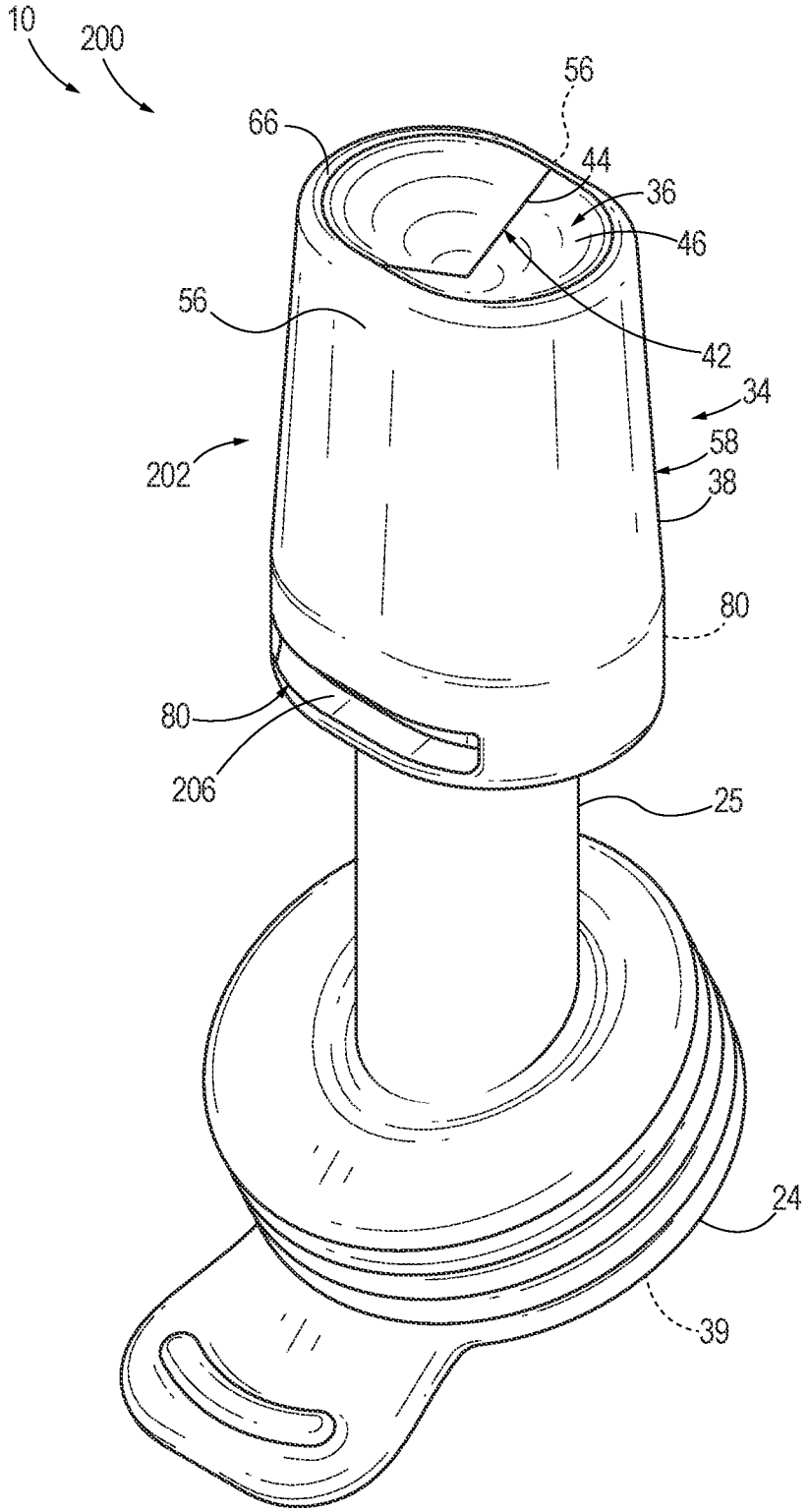
FIG. 19 is a perspective view of another example of a bite-actuated mouthpiece according to the present disclosure.
Figure 20:
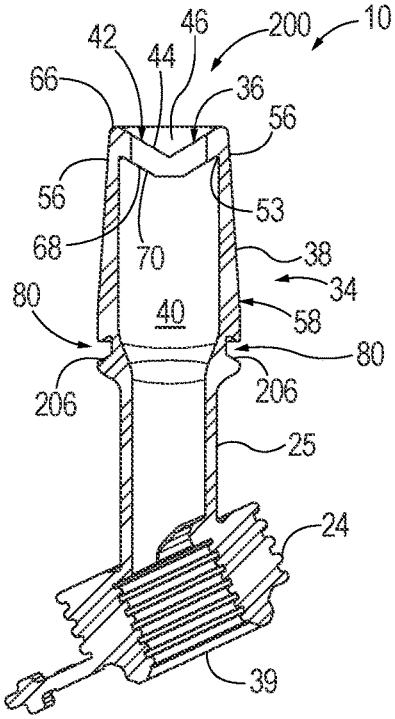
FIG. 20 is a cross-sectional side view of the bite-actuated mouthpiece of FIG. 19.
Figure 21:
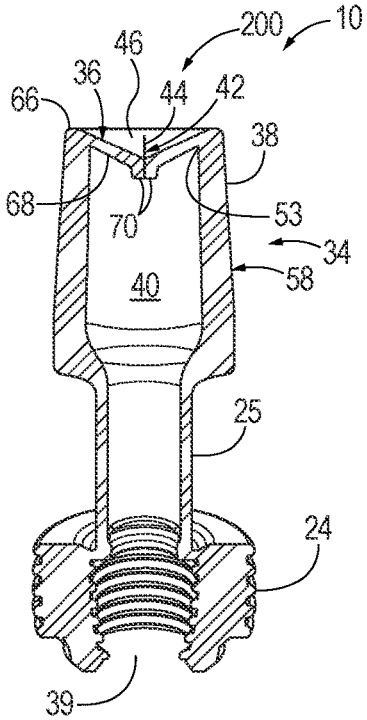
FIG. 21 is another cross-sectional side view of the bite-actuated mouthpiece of FIG. 19.
Figure 24:
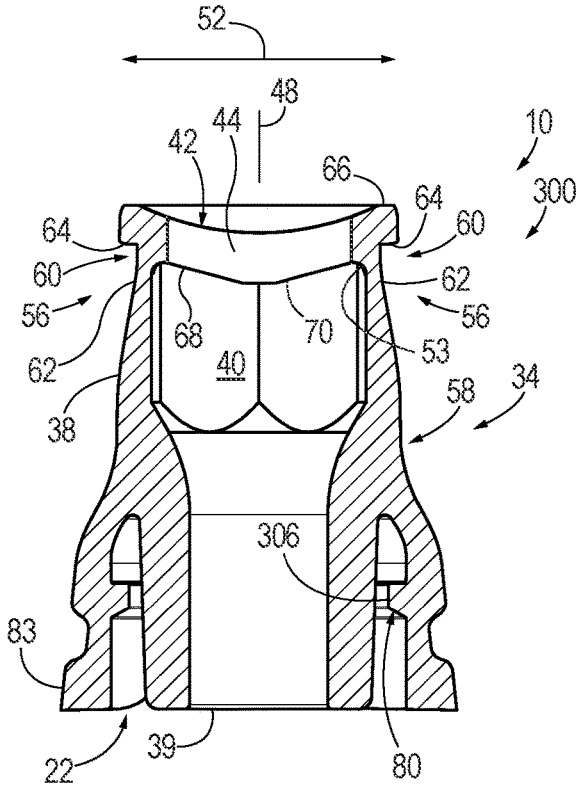
FIG. 24 is a cross-sectional side view of another example of a bite-actuated mouthpiece according to the present disclosure.
Figure 25:
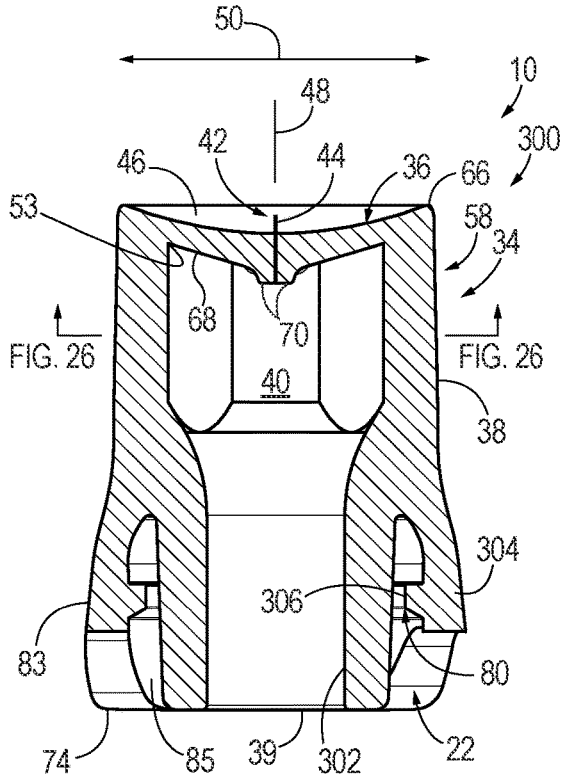
FIG. 25 is another cross-sectional side view of the bite-actuated mouthpiece of FIG. 24.
Figure 26:
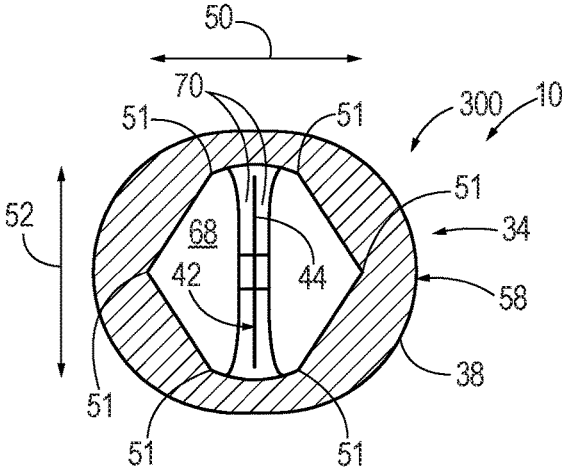
FIG. 26 is a cross-sectional end view of the bite-actuated mouthpiece of FIG. 24, taken along line 26-26 of FIG. 25.

A first specific example of a bite-actuated mouthpiece 10 is illustrated in FIGS. 9-13 and is referred to herein as bite-actuated mouthpiece 100. A second specific example of a bite-actuated mouthpiece 10 is illustrated in FIGS. 16-18 and is referred to herein as bite-actuated mouthpiece 110. A third specific example of bite-actuated mouthpieces 10 is illustrated in FIGS. 19-21, and is referred to herein as bite-actuated mouthpiece 200. A fourth specific example of bite-actuated mouthpieces 10 is illustrated in FIGS. 24-26 and is referred to herein as bite-actuated mouthpiece 300. A fifth example of bite-actuated mouthpieces 10 is illustrated in FIGS. 29-32, and is referred to herein as bite-actuated mouthpiece 400.

Each of mouthpieces 100, 110, 200, 300, and 400 are examples of mouthpieces 10 that have a concave dispensing face 46 and a single slit 44 that defines its self-sealing exit. Moreover, each of mouthpieces 100, 110, 200, 300, and 400 are examples of mouthpieces 10 whose maximum width of its body at the dispensing wall is greater in the first lateral dimension than in the second lateral dimension, with the slit being parallel to the second lateral dimension. Accordingly, in each of these examples, the outer surface of the body 34 may be described as generally elliptical, ovular, or otherwise oblong in the first lateral dimension 50.

In addition, the interior surface 68 of the dispensing face of each of mouthpieces 100, 110, 200, 300, and 400 extend from the one or more sidewalls 38 at an angle of at least 45°. Also, in each of mouthpieces 100, 110, 200, 300, and 400, the interior surface and the dispensing face are non-parallel to each other.

Additionally, each of mouthpieces 100, 110, 200, 300, and 400 are examples of mouthpieces 10 whose dispensing wall 36 comprises a pair of elongate projections 70 that extend from the interior surface 68 along the slit 44 and that at least partially define the slit. In addition, in these example mouthpieces, each elongate projection comprises first and second planar regions extending from the sidewalls 38 and a third planar region extending between the first and second planar regions, and with the third planar region being perpendicular to the longitudinal axis.

Each of these example mouthpieces is an example of a mouthpiece 10 whose sidewall thickness is not uniform at one or more cross-sections of the one or more sidewalls that are perpendicular to the longitudinal axis. In particular in these examples, at one or more cross-sections of the sidewalls that are perpendicular to the longitudinal axis, the sidewall thickness is greater in the first lateral dimension 50 than in the second lateral dimension 52.

Referring to FIGS. 9-13, bite-actuated mouthpiece 100 is an example of a bite-actuated mouthpiece 10 that is configured to be a component of a drink container 12 and/or a cap assembly 18 of a drink container 12; however, elements and characteristics of bite-actuated mouthpiece 100 may be used in connection with bite-actuated mouthpieces 10 that are configured to be a component of a hydration system 14 or other drink vessel 13.

Figure 11:
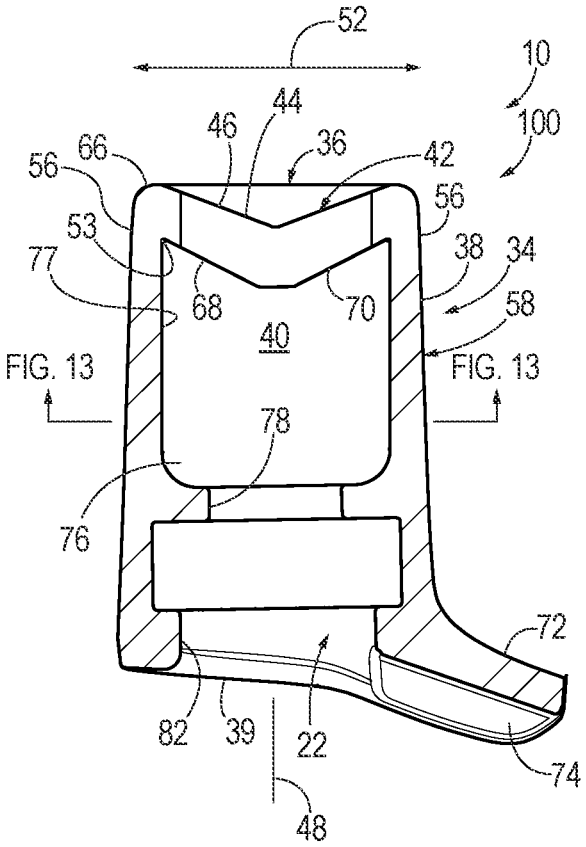
FIG. 11 is a cross-sectional side view of the bite-actuated mouthpiece of FIG. 9.
Figure 12:
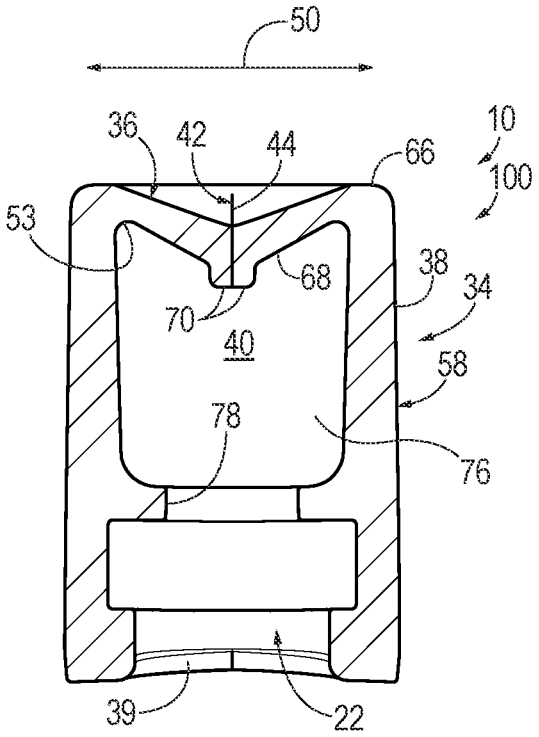
FIG. 12 is another cross-sectional side view of the bite-actuated mouthpiece of FIG. 9.
Figure 13:
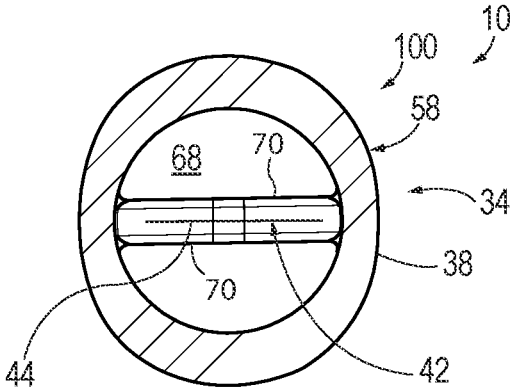
FIG. 13 is a cross-sectional end view of the bite-actuated mouthpiece of FIG. 9.

Mouthpiece 100 is an example of a mouthpiece 10 whose dispensing face is V-shaped at all cross-sections of the body that include the longitudinal axis 48. In addition and with particular reference to FIGS. 11 and 12, mouthpiece 100 also is an example of a mouthpiece 10, in which the transition 53 between the interior surface 68 and the sidewalls 38 has a radius of curvature that is greater at a first cross-section of the body that contains the longitudinal axis and that is in the first lateral dimension than at a second cross-section of the body that contains the longitudinal axis and that is in the second lateral dimension. As also seen in FIGS. 11 and 12, the dispensing wall 36 of mouthpiece 100 has a dispensing-wall thickness that increases toward the longitudinal axis relative to the sidewalls 38. In addition, the dispensing wall is thicker proximate the slit than proximate the sidewalls.

In addition, bite-actuated mouthpiece 100 is an example of a bite-actuated mouthpiece 10 that includes a flange 72 that extends from an outer surface of the barrel section 58 generally at a terminal end region of the barrel section 58 opposite the dispensing face 46. Moreover, the flange 72 defines a restrictive structure 74 in the form of a channel that extends into the flange 72 and that is sized and shaped to mate with a corresponding ridge of a cap assembly 18 of a drink container 12, such as a drink spout 20 of such a cap assembly, as shown in FIGS. 14 and 15.

Bite-actuated mouthpiece 100 is an example of a bite-actuated mouthpiece 10 that has a mount volume 22 defined between an inner wall 78 and a base wall 82 for operatively receiving a drink spout 20 of an associated drink container 12.

Figure 14:
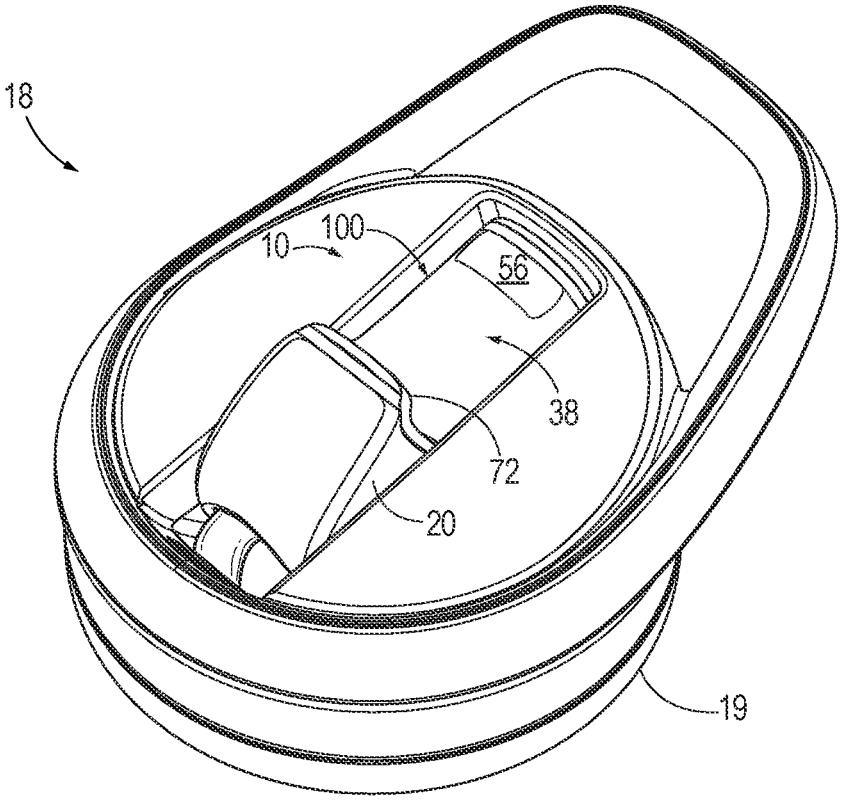
FIG. 14 is a perspective view of an example of a cap assembly of a drink container according to the present disclosure, including the bite-actuated mouthpiece of FIG. 9, with the bite-actuated mouthpiece in its stowed position.
Figure 15:
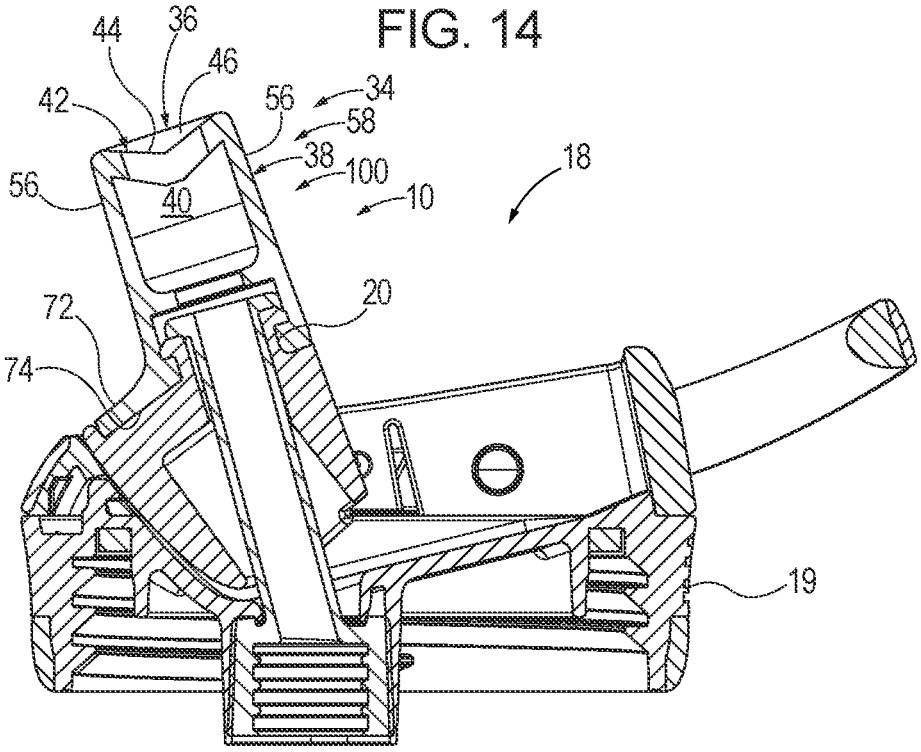
FIG. 15 is a cross-sectional side view of the cap assembly of FIG. 14, with the bite-actuated mouthpiece in its dispensing position.

FIGS. 14 and 15 illustrate an example of a suitable cap, or cap assembly 18, of a drink container 12 that includes bite-actuated mouthpiece 100. It is within the scope of the present disclosure that the cap assembly shown in FIGS. 14 and 15 may be utilized with other bite-actuated mouthpieces 10 according to the present disclosure. As illustrated in FIGS. 14 and 15, the example cap assembly 18 includes a drink spout 20 that is selectively pivoted within a range of pivotal positions relative to a base 19 of the cap assembly, such as to pivot the mouthpiece 100 from a stowed configuration that is proximate or even received at least partially within the base 19 of the cap assembly, to a dispensing position, in which the drink spout and mouthpiece extend away from the base of the cap assembly.

Referring to FIGS. 16-18, like bite-actuated mouthpiece 100, bite-actuated mouthpiece 110 is an example of a bite-actuated mouthpiece 10 that is configured to be a component of a drink container 12 and/or a cap assembly 18 of a drink container 12; however, elements and characteristics of bite-actuated mouthpiece 110 may be used in connection with bite-actuated mouthpieces 10 that are configured to be a component of a hydration system 14 or other drink vessel 13. More specifically, bite-actuated mouthpiece 110 is another example of a bite-actuated mouthpiece 10 that, like bite-actuated mouthpiece 100, includes a flange 72 that extends from an outer surface of the barrel section 58. Similar to the flange 72 of bite-actuated mouthpiece 100, the flange of bite-actuated mouthpiece 110 defines a restrictive structure 74 that is sized and shaped to mate with a corresponding ridge of a cap assembly 18 of a drink container 12, such as a drink spout 20 of such a cap assembly.

Figure 22:
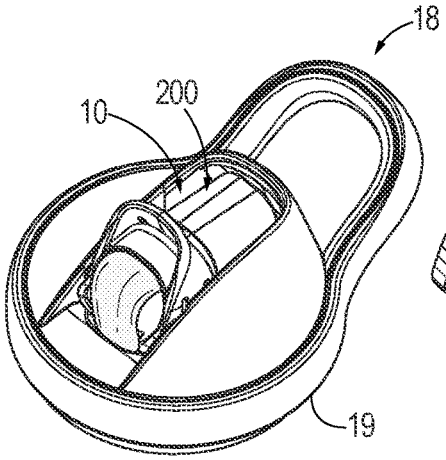
FIG. 22 is a perspective view of an example of a cap assembly of a drink container according to the present disclosure, including the bite-actuated mouthpiece of FIG. 19, with the bite-actuated mouthpiece in its stowed position.
Figure 23:
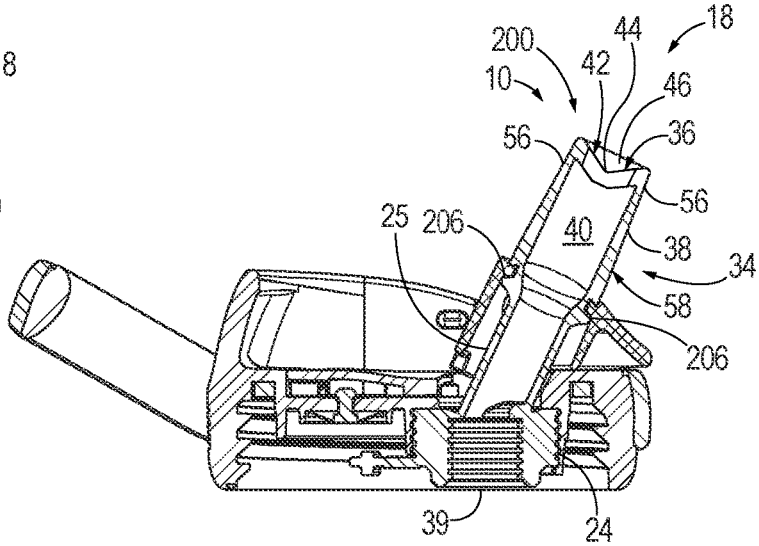
FIG. 23 is a cross-sectional side view of the cap assembly of FIG. 22, with the bite-actuated mouthpiece in its dispensing position.

Referring now to FIGS. 19-21, bite-actuated mouthpiece 200 also is an example of a bite-actuated mouthpiece 10 that is configured to be a component of a cap assembly 18 thereof, such as shown in FIGS. 22 and 23; however, elements and characteristics of bite-actuated mouthpiece 200 may be used in connection with bite-actuated mouthpieces 10 that are configured to be a component of a hydration system 14 or other drink vessel 13. As examples, bite-actuated mouthpiece 200 may be used with the drink containers disclosed in U.S. Pat. No. 8,191,727, incorporated herein.

More specifically, bite-actuated mouthpiece 200 is an example of a bite-actuated mouthpiece 10 that includes an anchor structure 24 that is configured to operatively couple with a cap assembly 18 of a drink container 12 and to restrict removal and/or permit selective removal of the bite-actuated mouthpiece 200 from the cap assembly 18.

Bite-actuated mouthpiece 200 is an example of a bite-actuated mouthpiece 10 with retention structure 80 in the form of two opposing grooves. Specifically, these grooves are configured to mate with a collar of an associated cap assembly 18 of a drink container 12.

Bite-actuated mouthpiece 200 additionally or alternatively may be described as a mouthpiece assembly that includes a mouthpiece portion 202 (including the dispensing wall 36 and the barrel section 58), the anchor structure 24, and a crimp tube 25 that interconnects the anchor structure 24 to the mouthpiece portion 202 for delivery of drink liquid from an associated liquid vessel 16 to the mouthpiece portion 202. The crimp tube 25 is configured to be operatively and selectively crimped and uncrimped by corresponding structure of a drink container 12 responsive to user manipulation of the drink container 12, such that the drink container 12 defines an on/off valve that is distinct from the self-sealing exit 42 of the bite-actuated mouthpiece 200. In the illustrated example of mouthpiece 200, the mouthpiece portion, the anchor structure and the crimp tube are constructed as a single monolithic body of a resilient material.

Figure 27:
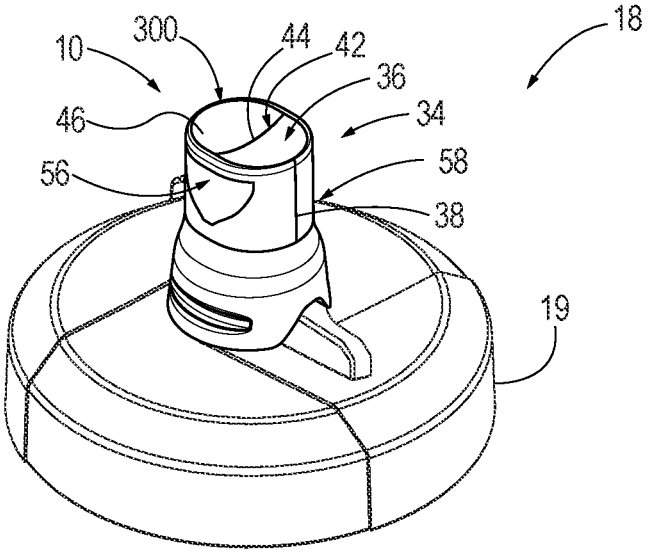
FIG. 27 is a perspective view of an example of a cap assembly of a drink container according to the present disclosure, including the bite-actuated mouthpiece of FIG. 24.
Figure 28:
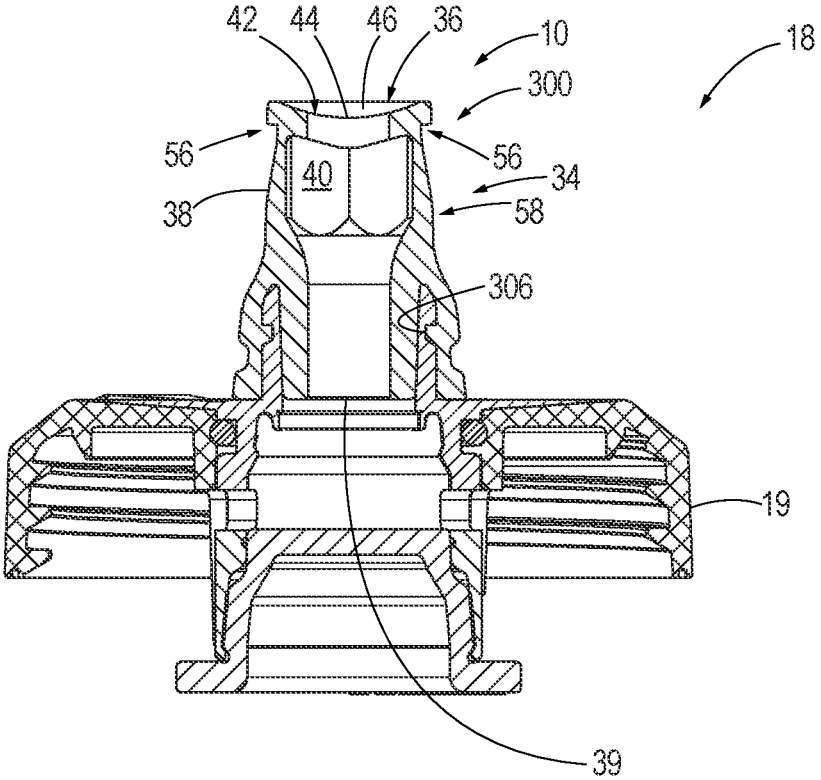
FIG. 28 is a cross-sectional view of the cap assembly of FIG. 27.
Figure 29:
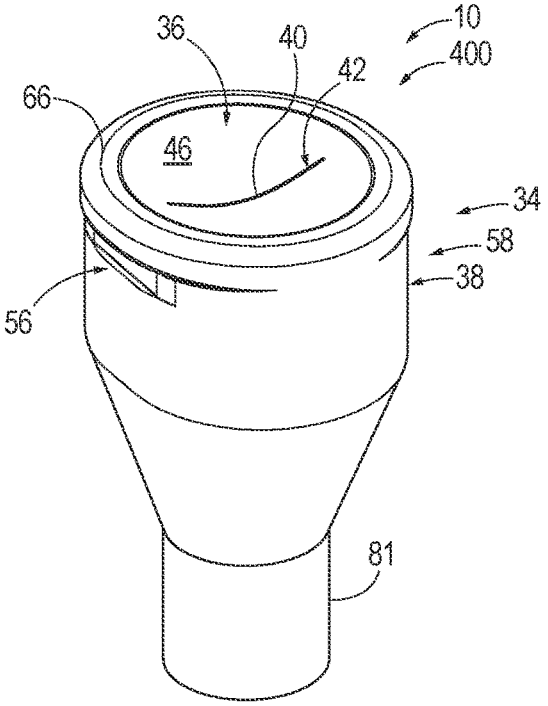
FIG. 29 is a perspective view of another example of a bite-actuated mouthpiece according to the present disclosure.

Referring next to FIGS. 24-26, bite-actuated mouthpiece 300 also is an example of a bite-actuated mouthpiece 10 that is configured to be a component of a cap assembly 18, an example of which is shown in FIGS. 27 and 28; however, elements and characteristics of bite-actuated mouthpiece 300 may be used in connection with bite-actuated mouthpieces 10 that are configured to be a component of a hydration system 14 or other drink vessel 13.

More specifically, bite-actuated mouthpiece 300 is an example of a bite-actuated mouthpiece 10 that includes opposing recesses 60 that define opposing bite regions 56, with each recess 60 having a ramped face 62 and a ledge surface 64.

Bite-actuated mouthpiece 300 includes an inner skirt 302 and an outer skirt 304 that extend away from the barrel section 58 relative to the dispensing wall 36. The inner skirt 302 and the outer skirt 304 define a mount volume 22 that is sized and shaped to receive and mate with corresponding mount structure of an associated drink container 12 or cap assembly thereof. Outer skirt 304 is an example of a sleeve 83, with mount volume 22 providing an example of channel 85. Bite-actuated mouthpiece 300 also includes retention structure 80 in the form of a flange 306 extending into the mount volume 22 from the outer skirt 304, with the flange 306 being configured to engage and mate with corresponding structure of the mount structure of an associated drink container or cap assembly thereof when received in the mount volume 22.

Figure 33:
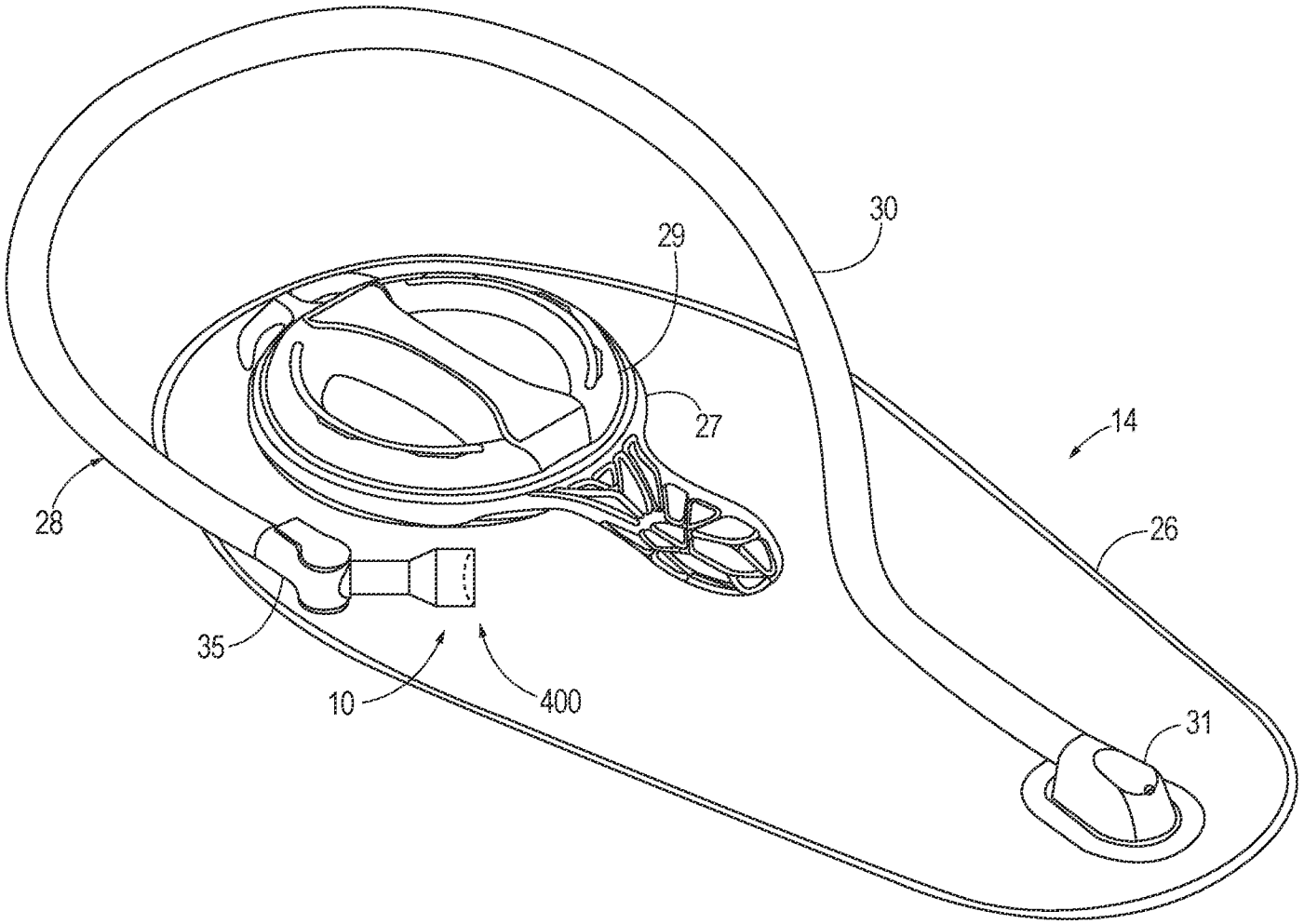
FIG. 33 is a perspective view of an example of a hydration system according to the present disclosure, including the bite-actuated mouthpiece of FIG. 29.

Referring now to FIGS. 29-32, bite-actuated mouthpiece 400 is an example of a bite-actuated mouthpiece 10 that is configured to be a component of a hydration system 14, such as the hydration system of FIG. 33; however, elements and characteristics of bite-actuated mouthpiece 400 may be used in connection with bite-actuated mouthpieces 10 that are configured to be a component of a drink container 12 or other drink vessel 13.

Figure 30:
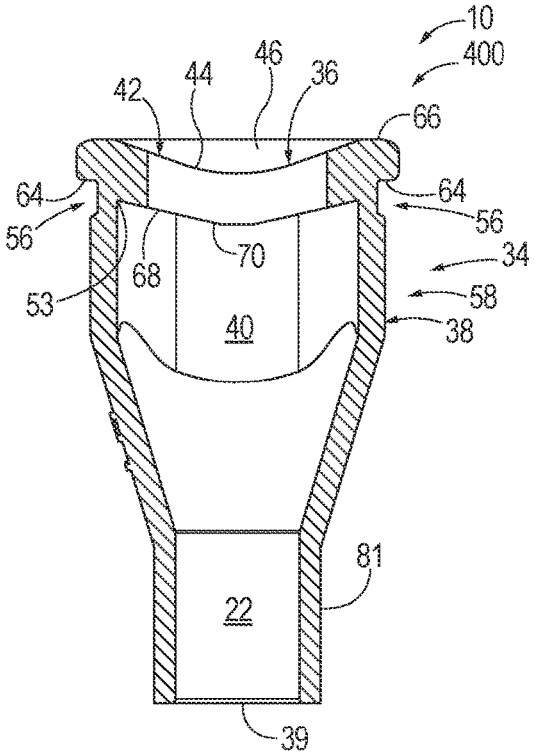
FIG. 30 is a cross-sectional side view of the bite-actuated mouthpiece of FIG. 29.
Figure 31:
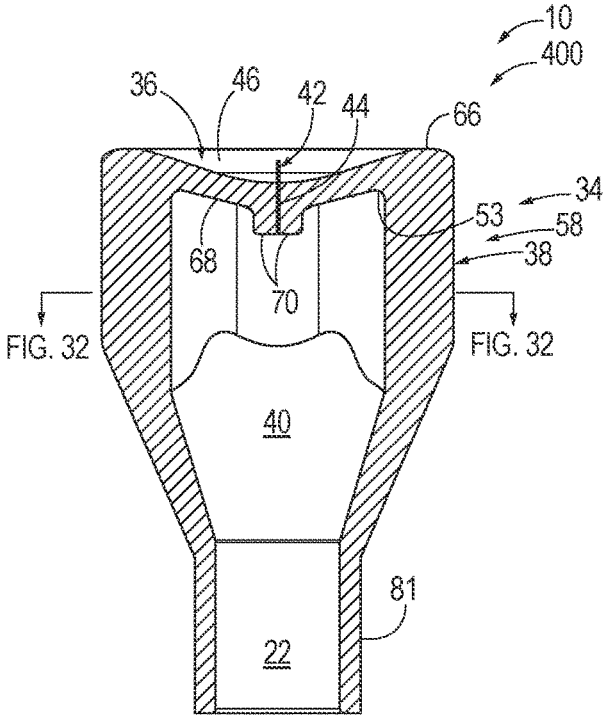
FIG. 31 is another cross-sectional side view of the bite-actuated mouthpiece of FIG. 29.
Figure 32:
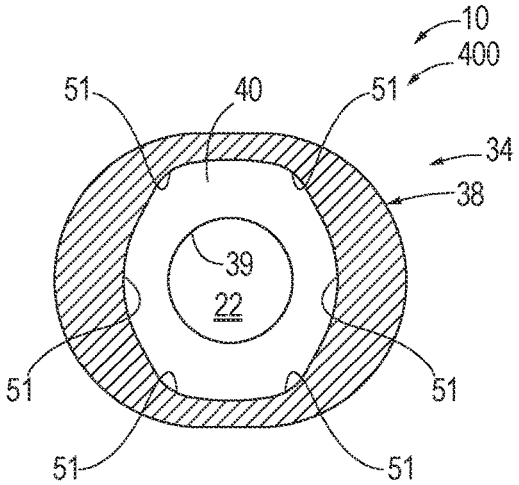
FIG. 32 is a cross-sectional end view of the bite-actuated mouthpiece of FIG. 29, taken along line 32-32 of FIG. 31.

Like mouthpiece 100, bite-actuated mouthpiece 400 is an example of a mouthpiece 10, in which the transition 53 between the interior surface 68 and the sidewalls 38 has a radius of curvature that is greater at a first cross-section of the body that contains the longitudinal axis and that is in the first lateral dimension than at a second cross-section of the body that contains the longitudinal axis and that is in the second lateral dimension, as seen with reference to FIGS. 30 and 31.

Bite-actuated mouthpiece 400 is an example of a bite-actuated mouthpiece 10 that has a mount volume 22 that is sized to receive and mate with an elongate drink tube 30 or other component of a hydration system 14.

The sidewalls 38 of the body 34 of bite-actuated mouthpiece 400 taper inward from the barrel section 58 to a neck region 81 that defines the mount volume 22.

As seen in FIGS. 30 and 31, at all cross-sections of mouthpiece 400 containing the longitudinal axis, the dispensing face is straight within an outer region and arcuate within an inner region.

FIG. 33 illustrates an example of a hydration system 14 to which a bite-actuated mouthpiece 10, such as bite-actuated mouthpiece 400, may be fluidly coupled. As shown, hydration system 14 includes a reservoir, or bladder, 26 that is sized to receive a volume of drink liquid. An elongate drink tube 30 extends from the reservoir, such as being fluidly coupled thereto by an exit port 31. As illustrated, the drink tube forms a portion of a downstream assembly 28 that also includes bite-actuated mouthpiece 10 and an optional component 35, such as a manual on/off valve. The reservoir includes a fill port 27, which in the illustrated embodiment is selectively sealed by a cap 29.

Examples of bite-actuated mouthpieces, drink containers, and hydration systems according to the present disclosure are described in the following enumerated paragraphs:

A. A bite-actuated mouthpiece, comprising:

a body, comprising:

a dispensing wall, wherein the dispensing wall comprises a self-sealing exit;

one or more sidewalls extending from the dispensing wall, wherein the one or more sidewalls and the dispensing wall define an internal volume; and an inlet to the internal volume;

wherein the one or more sidewalls comprise opposing bite regions; wherein the self-sealing exit is selectively configured between a closed configuration, in which the self-sealing exit is closed and drink liquid in the internal volume may not be dispensed through the self-sealing exit, and an open configuration, in which the self-sealing exit is open and drink liquid in the internal volume may be dispensed through the self-sealing exit; and wherein the self-sealing exit is biased toward the closed configuration and is configured to be selectively reconfigured from the closed configuration to the open configuration responsive to user-applied compressive forces to the opposing bite regions.

A1. The bite-actuated mouthpiece of paragraph A, wherein the bite-actuated mouthpiece has a longitudinal axis that extends through the inlet, the internal volume, and the self-sealing exit, wherein the bite-actuated mouthpiece has a first lateral dimension and a second lateral dimension that is perpendicular to the first lateral dimension, and wherein the first lateral dimension and the second lateral dimension are perpendicular to the longitudinal axis.

A2. The bite-actuated mouthpiece of any of paragraphs A-A1, wherein the self-sealing exit comprises at least one slit; wherein when the self-sealing exit is in the closed configuration, opposing faces of the at least one slit are engaged together to restrict liquid flow through the self-sealing exit, and when the self-sealing exit is in the open configuration, the opposing faces of the at least one slit are separated to permit liquid flow through the self-sealing exit.

A2.1. The bite-actuated mouthpiece of paragraph A2 when depending from paragraph A1, wherein the at least one slit is parallel to the second lateral dimension.

A2.2. The bite-actuated mouthpiece of paragraph A2 when depending from paragraph A1, wherein the at least one slit consists of a single slit, and wherein the single slit is parallel to the second lateral dimension, and wherein the opposing bite regions extend generally in the first lateral dimension.

A2.3. The bite-actuated mouthpiece of any of paragraphs A2-A2.2 when depending from paragraph A1, wherein a maximum width of the body in the first lateral dimension at the dispensing wall is greater than a maximum width of the body in the second lateral dimension at the dispensing wall.

A3. The bite-actuated mouthpiece of any of paragraphs A-A2.3, wherein the dispensing wall has a dispensing face opposite the internal volume, and wherein the dispensing face is concave.

A3.1. The bite-actuated mouthpiece of paragraph A1, wherein the one or more sidewalls define a circumferential lip that defines a distal-most surface of the body relative to the inlet, and wherein the dispensing wall extends from the circumferential lip toward the internal volume.

A3.1.1. The bite-actuated mouthpiece of paragraph A3.1 when depending from paragraph A1, wherein a maximum width of the body in the first lateral dimension at the circumferential lip is greater than a maximum width of the body in the second lateral dimension at the circumferential lip.

A3.2. The bite-actuated mouthpiece of any of paragraphs A3-A3.1.1, wherein the dispensing wall has an interior surface that faces the internal volume, and wherein the interior surface extends from the one or more sidewalls at an angle of at least 45°.

A3.3. The bite-actuated mouthpiece of any of paragraphs A3-A3.2, wherein the dispensing face is conical.

A3.4. The bite-actuated mouthpiece of any of paragraphs A3-A3.3, wherein the dispensing face has a truncated conical shape.

A3.5. The bite-actuated mouthpiece of any of paragraphs A3-A3.2, wherein the dispensing face is bowl-shaped.

A3.6. The bite-actuated mouthpiece of any of paragraphs A3-A3.2, wherein the bite-actuated mouthpiece has a/the longitudinal axis that extends through the inlet, the internal volume, and the self-sealing exit; and wherein at one or more cross-sections of the body that include the longitudinal axis, the dispensing face is V-shaped.

A3.7. The bite-actuated mouthpiece of any of paragraphs A3-A3.6, wherein the dispensing wall has an/the interior surface that faces the internal volume, and wherein a transition between the interior surface and the one or more sidewalls has a radius of curvature.

A3.7.1. The bite-actuated mouthpiece of paragraph A3.7, wherein the radius of curvature is generally uniform around the internal volume.

A3.7.2. The bite-actuated mouthpiece of paragraph A3.7, wherein the radius of curvature varies around the internal volume.

A3.7.3. The bite-actuated mouthpiece of paragraph A3.7 when depending from paragraph A1, wherein the radius of curvature at a first cross-section of the body that contains the longitudinal axis and that is in the first lateral dimension is greater than at a second cross-section of the body that contains the longitudinal axis and that is in the second lateral dimension.

A3.7.4. The bite-actuated mouthpiece of paragraph A3.7, wherein the radius of curvature is smaller closer to the self-sealing exit than away from the self-sealing exit.

A3.8. The bite-actuated mouthpiece of any of paragraphs A3-A3.7.4, wherein the dispensing face has a uniform radius of curvature.

A3.9. The bite-actuated mouthpiece of any of paragraphs A3-A3.7.4, wherein the dispensing face has a non-uniform radius of curvature.

A3.10. The bite-actuated mouthpiece of any of paragraphs A3-A3.9, wherein the dispensing wall has an/the interior surface that faces the internal volume, and wherein the interior surface and the dispensing face are parallel.

A3.11. The bite-actuated mouthpiece of any of paragraphs A3-A3.9, wherein the dispensing wall has an/the interior surface that faces the internal volume, and wherein the interior surface and the dispensing face are non-parallel.

A3.12. The bite-actuated mouthpiece of any of paragraphs A3-A3.11, wherein the dispensing face has an/the outer region that is proximate to the one or more sidewalls and an inner region that is positioned radially inward relative to the outer region.

A3.12.1. The bite-actuated mouthpiece of paragraph A3.12, wherein the outer region is conical and the inner region is bowl-shaped.

A3.12.2. The bite-actuated mouthpiece of paragraph A3.12, wherein the outer region is bowl-shaped and the inner region is planar.

A3.12.3. The bite-actuated mouthpiece of paragraph A3.12, wherein the bite-actuated mouthpiece has a/the longitudinal axis that extends through the inlet, the internal volume, and the self-sealing exit; and wherein at one or more cross-sections containing the longitudinal axis, the dispensing face is straight within the outer region and arcuate or parabolic within the inner region.

A3.12.3.1. The bite-actuated mouthpiece of paragraph A3.12.3, wherein at all cross-sections containing the longitudinal axis, the dispensing face is straight within the outer region and arcuate or parabolic within the inner region.

A3.12.4. The bite-actuated mouthpiece of paragraph A3.12, wherein the bite-actuated mouthpiece has a/the longitudinal axis that extends through the inlet, the internal volume, and the self-sealing exit; and wherein at one or more cross-sections containing the longitudinal axis, the dispensing face is straight within the outer region and straight within the inner region.

A3.12.4.1. The bite-actuated mouthpiece of paragraphs A3.12.4, wherein the dispensing face is perpendicular to the longitudinal axis within the inner region.

A3.12.4.2. The bite-actuated mouthpiece of any of paragraphs A3.12.4-A3.12.4.1, wherein at all cross-sections containing the longitudinal axis, the dispensing face is straight within the outer region and straight within the inner region.

A3.12.5. The bite-actuated mouthpiece of paragraph A3.12, wherein the bite-actuated mouthpiece has a/the longitudinal axis that extends through the inlet, the internal volume, and the self-sealing exit; and wherein at one or more cross-sections containing the longitudinal axis, the dispensing face is arcuate or parabolic within the outer region and straight within the inner region.

A3.12.5.1. The bite-actuated mouthpiece of paragraph A3.12.5, wherein the dispensing face is perpendicular to the longitudinal axis within the inner region.

A3.12.5.2. The bite-actuated mouthpiece of any of paragraphs A3.12.5-A3.12.5.1, wherein at all cross-sections containing the longitudinal axis, the dispensing face is arcuate or parabolic within the outer region and straight within the inner region.

A3.13. The bite-actuated mouthpiece of any of paragraphs A3-A3.12.5.2, wherein when the self-sealing exit transitions from the closed configuration to the open configuration, the dispensing face flexes toward the internal volume.

A3.14. The bite-actuated mouthpiece of any of paragraphs A3-A3.13, wherein when the self-sealing exit is in the closed configuration, a sealing force of the self-sealing exit increases responsive to an increase in a liquid pressure within the internal volume.

A4. The bite-actuated mouthpiece of any of paragraphs A-A3.14, wherein the dispensing wall has a dispensing-wall thickness.

A4.1. The bite-actuated mouthpiece of paragraph A4, wherein the dispensing-wall thickness is generally uniform.

A4.2. The bite-actuated mouthpiece of paragraph A4, wherein the dispensing-wall thickness increases toward the self-sealing exit relative to the one or more sidewalls.

A4.3. The bite-actuated mouthpiece of paragraph A4 or A4.2, wherein the bite-actuated mouthpiece has a/the longitudinal axis that extends through the inlet, the internal volume, and the self-sealing exit; and wherein the dispensing-wall thickness increases toward the longitudinal axis relative to the one or more sidewalls.

A4.4. The bite-actuated mouthpiece of paragraph A4, wherein the dispensing-wall thickness decreases toward the self-sealing exit relative to the one or more sidewalls.

A4.5. The bite-actuated mouthpiece of paragraph A4 or A4.4, wherein the bite-actuated mouthpiece has a/the longitudinal axis that extends through the inlet, the internal volume, and the self-sealing exit; and wherein the dispensing-wall thickness decreases toward the longitudinal axis relative to the one or more sidewalls.

A5. The bite-actuated mouthpiece of any of paragraphs A-A4.5, wherein the dispensing wall is thicker proximate the self-sealing exit than proximate the one or more sidewalls.

A6. The bite-actuated mouthpiece of any of paragraphs A-A5, wherein the self-sealing exit comprises at least one slit; wherein the dispensing wall has an/the interior surface that faces the internal volume; and wherein the dispensing wall comprises a pair of elongate projections that extend from the interior surface along the at least one slit and at least partially define the at least one slit.

A6.1. The bite-actuated mouthpiece of paragraph A6, wherein the pair of elongate projections spans the internal volume between opposing ones of the one or more sidewalls.

A6.2. The bite-actuated mouthpiece of any of paragraphs A6-A6.1, wherein the bite-actuated mouthpiece has a/the longitudinal axis that extends through the inlet, the internal volume, and the self-sealing exit; and wherein each of the pair of elongate projections comprises a planar region that is perpendicular to the longitudinal axis.

A6.2.1. The bite-actuated mouthpiece of paragraph A6.2, wherein the planar region spans less than an entirety of the respective elongate projection.

A6.3. The bite-actuated mouthpiece of any of paragraphs A6-A6.2.1, wherein each of the pair of elongate projections comprises three planar regions including first and second planar regions extending from the one or more sidewalls and a third planar region extending between the first and second planar regions.

A6.3.1. The bite-actuated mouthpiece of paragraph A6.3, wherein the first and second planar regions extend from the one or more sidewalls at an angle of at least 45°.

A6.3.2. The bite-actuated mouthpiece of any of paragraphs A6.3-A6.3.1, wherein the bite-actuated mouthpiece has a/the longitudinal axis that extends through the inlet, the internal volume, and the self-sealing exit; and wherein the third planar region is perpendicular to the longitudinal axis.

A7. The bite-actuated mouthpiece of any of paragraphs A-A6.3.2, wherein the one or more sidewalls define a/the circumferential lip that defines a/the distal-most surface of the body relative to the inlet.

A7.1. The bite-actuated mouthpiece of paragraph A7, wherein the circumferential lip extends beyond the dispensing wall relative to the internal volume.

A8. The bite-actuated mouthpiece of any of paragraphs A-A7.1, wherein the one or more sidewalls have a sidewall thickness.

A8.1. The bite-actuated mouthpiece of paragraph A8, wherein sidewall thickness is generally uniform.

A8.2. The bite-actuated mouthpiece of paragraph A8, wherein the sidewall thickness varies.

A8.3. The bite-actuated mouthpiece of paragraph A8 when depending from paragraph A7, wherein the sidewall thickness increases from proximate the circumferential lip toward the inlet.

A8.4. The bite-actuated mouthpiece of paragraph A8 when depending from paragraph A7, wherein the sidewall thickness increases from distal the circumferential lip toward proximate the circumferential lip.

A8.5. The bite-actuated mouthpiece of any of paragraphs A8-A8.4, wherein the bite-actuated mouthpiece has a/the longitudinal axis that extends through the inlet, the internal volume, and the self-sealing exit; and wherein at one or more cross-sections of the one or more sidewalls that are perpendicular to the longitudinal axis, the sidewall thickness is generally uniform.

A8.6. The bite-actuated mouthpiece of any of paragraphs A8-A8.4, wherein the bite-actuated mouthpiece has a/the longitudinal axis that extends through the inlet, the internal volume, and the self-sealing exit; and wherein at one or more cross-sections of the one or more sidewalls that are perpendicular to the longitudinal axis, the sidewall thickness is not uniform.

A8.7. The bite-actuated mouthpiece of any of paragraphs A8-A8.4 when depending from paragraph A1, wherein at one or more cross-sections of the one or more sidewalls that are perpendicular to the longitudinal axis, the sidewall thickness is greater in the first lateral dimension than in the second lateral dimension.

A9. The bite-actuated mouthpiece of any of paragraphs A-A8.7, wherein the bite-actuated mouthpiece has a/the longitudinal axis that extends through the inlet, the internal volume, and the self-sealing exit; wherein the one or more sidewalls have an internal surface that faces the internal volume; and wherein at one or more cross-sections of the one or more sidewalls that are perpendicular to the longitudinal axis, the internal surface has three or more apexes between adjacent surface regions.

A9.1. The bite-actuated mouthpiece of paragraph A9, wherein the three or more apexes consist of six apexes.

A9.2. The bite-actuated mouthpiece of any of paragraphs A9-A9.1, wherein one or more of the adjacent surface regions are arcuate.

A9.2.1. The bite-actuated mouthpiece of paragraph A9.2, wherein one or more of the adjacent surface regions are convex.

A9.2.2. The bite-actuated mouthpiece of any of paragraphs A9.2-A9.2.1, wherein one or more of the adjacent surface regions are concave.

A9.3. The bite-actuated mouthpiece of any of paragraphs A9-A9.2.2, wherein one or more of the adjacent surface regions are planar.

A10. The bite-actuated mouthpiece of any of paragraphs A-A9.3, wherein the one or more sidewalls define a barrel section of the body, wherein the barrel section extends around the internal volume; and wherein the body further comprises a flange that extends from the barrel section away from the internal volume.

A10.1. The bite-actuated mouthpiece of paragraph A10, wherein the flange extends from the barrel section at a terminal end region of the barrel section opposite the dispensing wall.

A10.2. The bite-actuated mouthpiece of any of paragraphs A10-A10.1, wherein the flange extends from less than 60% of a perimeter of the barrel section.

A10.3. The bite-actuated mouthpiece of any of paragraphs A10-A10.2, wherein the flange comprises a restrictive structure that is configured to mate with a corresponding structure of a drink container or of a hydration system to restrict rotation of the bite-actuated mouthpiece relative thereto.

A10.3.1. The bite-actuated mouthpiece of paragraph A10.3, wherein the restrictive structure comprises a channel extending into the flange.

A11. The bite-actuated mouthpiece of any of paragraphs A-A10.3.1, wherein the body comprises a mouthpiece portion, an anchor structure, and a crimp tube that interconnects the anchor structure and mouthpiece portion; wherein the anchor structure is configured to engage with corresponding structure of a component of a drink container to restrict unintentional removal of the bite-actuated mouthpiece from the component of the drink container; and wherein the crimp tube is configured to be operatively and selectively crimped and uncrimped by corresponding structure of the drink container responsive to user manipulation of the drink container, such that the drink container defines an on/off valve that is distinct from the self-sealing exit.

A11.1. The bite-actuated mouthpiece of paragraph A11, wherein at least two of the mouthpiece portion, the anchor structure, and the crimp tube are constructed as a single monolithic body of a resilient material.

A11.2. The bite-actuated mouthpiece of any of paragraphs A11-A11.1, wherein the mouthpiece portion, the anchor structure, and the crimp tube are constructed as a single monolithic body of a resilient material.

A12. The bite-actuated mouthpiece of any of paragraphs A-A10.3.1, wherein the one or more sidewalls define a barrel section of the body, wherein the barrel section extends around the internal volume and comprises a neck region that defines the inlet and that has a smaller cross-sectional area than a downstream portion of the barrel section.

A12.1. The bite-actuated mouthpiece of paragraph A12, wherein the neck region is configured to receive or be received by an upstream component of a drink container or a hydration system.

A13. The bite-actuated mouthpiece of any of paragraphs A-A12.1, wherein the bite-actuated mouthpiece is constructed as a single monolithic body of a resilient material.

A14. The bite-actuated mouthpiece of any of paragraphs A-A12.1, wherein the body is constructed as a single monolithic body of a resilient material.

A15. The bite-actuated mouthpiece of any of paragraphs A-A14, further comprising any one or more of the elements, features, aspects, configurations, dimensions, characteristics, and/or properties disclosed and/or incorporated herein.

A16. The use of the bite-actuated mouthpiece of any of paragraphs A-A15 to dispense liquid to a user from a drink vessel.

B. A drink vessel, comprising:

a liquid reservoir sized to hold a volume of drink liquid; and the bite-actuated mouthpiece of any of paragraphs A-A15 operatively coupled to the liquid reservoir.

B1. The drink vessel of paragraph B, wherein the drink vessel is a drink container according to the present disclosure, including of any of paragraphs C-C3.1.2.

B2. The drink vessel of paragraph B, wherein the drink vessel is a hydration system according to the present disclosure, including of any of paragraphs D-D4.

C. A drink container, comprising:

a liquid vessel sized to hold a volume of drink liquid; and a cap assembly configured to be operatively and selectively coupled to and removed from the liquid vessel, wherein the cap assembly comprises the bite-actuated mouthpiece of any of paragraphs A-A15.

C1. The drink container of paragraph C, wherein the liquid vessel is at least one of rigid, semi-rigid, resilient, and collapsible (non-resilient).

C2. The drink container of any of paragraphs C-C1, wherein the drink container is a water bottle, a sports bottle, a squeeze, bottle, a semi-rigid bottle, or a collapsible flask.

C3. The drink container of any of paragraphs C-C2, wherein the cap assembly comprises a drink spout, and wherein bite-actuated mouthpiece is operatively coupled to the drink spout.

C3.1. The drink container of paragraph C3, wherein the cap assembly further comprises a cap base, and wherein the drink spout extends from the cap base.

C3.1.1. The drink container of paragraph C3.1, wherein the drink spout extends in a fixed orientation relative to the cap base.

C3.1.2. The drink container of paragraph C3.1, wherein the drink spout is configured to be selectively moved (optionally pivoted) relative to the cap base.

D. A hydration system, comprising:

the bite-actuated mouthpiece of any of paragraphs A-A15;

a liquid reservoir sized to hold a volume of drink liquid; and a downstream assembly that fluidly interconnects the liquid reservoir to the bite-actuated mouthpiece.

D1. The hydration system of paragraph D, wherein the liquid reservoir comprises a flexible bladder.

D2. The hydration system of any of paragraphs D-D1, wherein the liquid reservoir comprises:

a fill port configured to receive drink liquid into the liquid reservoir; and an exit port that defines a passage for delivering drink liquid from the liquid reservoir to the downstream assembly.

D3. The hydration system of any of paragraphs D-D2, wherein the downstream assembly comprises one or more of an elongate flexible drink tube, an on/off valve configured to selectively obstruct flow through the elongate flexible drink tube, a quick connect assembly configured to selectively and fluidly interconnect at least two fluidly interconnected components of the downstream assembly, a pump, a filter, and/or a liquid flowmeter.

D4. The hydration system of any of paragraphs D-D3, further comprising:

a body-worn pack, a garment, or a carrier configured to operatively receive at least the liquid reservoir of the hydration system.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, "operative" and "operatively," when modifying an action, movement, configuration, interconnection, coupling, or other relationship of one or more components of a drink container according to the present disclosure, means that the specified action, movement, configuration, interconnection, coupling or other relationship is performed and/or achieved as a result of standard (i.e., intended) operation and/or functional utilization of the one or more components of the drink container, such as in a manner described herein.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are at least 75% as long as the second length and also includes first lengths that are as long as the second length. As yet another example, elements that are at least substantially parallel includes elements that extend in directions that deviate by up to 22.5° and also includes elements that are parallel.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A bite-actuated mouthpiece, comprising:

a dispensing wall extending from one or more sidewalls and comprising a self-sealing exit, the self-sealing exit being selectively configured to transition between a closed configuration, in which the self-sealing exit is closed, and an open configuration, in which the self-sealing exit is open, wherein the one or more sidewalls form a barrel section, the one or more sidewalls being sloped such that a diameter of the barrel section narrows from an end of the mouthpiece opposite the dispensing wall to a second end of the mouthpiece including the dispensing wall; and an inlet to an internal volume formed by the one or more sidewalls and the dispensing wall;

wherein the self-sealing exit is biased toward the closed configuration and is configured to transition from the closed configuration to the open configuration responsive to user-applied compressive forces to opposing bite regions disposed on the one or more sidewalls; and wherein an entirety of the dispensing wall from the one or more sidewalls to a center of the dispensing wall is sloped downwards toward the internal volume and has a thickness that continuously increases from a minimum thickness adjacent to the one or more sidewalls to a maximum thickness at the center of the dispensing wall.

2. The bite-actuated mouthpiece of claim 1, wherein the self-sealing exit comprises at least one slit.

3. The bite-actuated mouthpiece of claim 2, wherein the dispensing wall comprises an interior surface that faces the internal volume and comprises a pair of elongate projections that extend from the interior surface.

4. The bite-actuated mouthpiece of claim 3, wherein the pair of elongate projections extend from the interior surface along the at least one slit and at least partially define the at least one slit.

5. The bite-actuated mouthpiece of claim 2, wherein the at least one slit comprises two intersecting slits.

6. The bite-actuated mouthpiece of claim 1, wherein the dispensing wall has a dispensing wall thickness that continuously increases from a minimum thickness adjacent to the one or more sidewalls to a maximum thickness at a center of the dispensing wall.

7. The bite-actuated mouthpiece of claim 1, wherein the one or more sidewalls have a sidewall thickness and wherein the sidewall thickness narrows from an end of the mouthpiece opposite the dispensing wall to a second end of the mouthpiece including the dispensing wall.

8. The bite-actuate mouthpiece of claim 1, wherein the dispensing wall has an interior surface that faces the internal volume and wherein the interior surface extends from the one or more sidewalls at an acute angle.

9. The bite-actuate mouthpiece of claim 8, wherein the interior surface extends from the one or more sidewalls at an angle of at least 45°.

10. A bite-actuated mouthpiece, comprising:

a dispensing wall extending from one or more sidewalls and comprising a self-sealing exit, the self-sealing exit being selectively configured to transition between a closed configuration, in which the self-sealing exit is closed, and an open configuration, in which the self-sealing exit is open, in response to user-applied compressive forces to bite regions disposed on the one or more sidewalls; and an inlet to an internal volume formed by the one or more sidewalls and the dispensing wall;

wherein the dispensing wall has a dispensing wall thickness that continuously increases from a minimum thickness adjacent to the one or more sidewalls to a maximum thickness at a center of the dispensing wall;

wherein the one or more sidewalls form a barrel section, the one or more sidewalls being sloped such that a diameter of the barrel section narrows from a first end of the mouthpiece opposite the dispensing wall to a second end of the mouthpiece including the dispensing wall; and wherein a sidewall thickness of the one or more sidewalls increases away from the dispensing wall.

11. The bite-actuated mouthpiece of claim 10, wherein the self-sealing exit comprises at least one slit.

12. The bite-actuated mouthpiece of claim 11, wherein the dispensing wall comprises an interior surface that faces the internal volume and comprises a pair of elongate projections that extend from the interior surface.

13. The bite-actuated mouthpiece of claim 12, wherein the pair of elongate projections extend from the interior surface along the at least one slit and at least partially define the at least one slit.

14. The bite-actuated mouthpiece of claim 11, wherein the at least one slit comprises two intersecting slits.

15. The bite-actuated mouthpiece of claim 10, wherein an entirety of the dispensing wall from the one or more sidewalls to a center of the dispensing wall is sloped downwards toward the internal volume.

16. The bite-actuated mouthpiece of claim 10, wherein the one or more sidewalls have a sidewall thickness and wherein the sidewall thickness narrows from an end of the mouthpiece opposite the dispensing wall to a second end of the mouthpiece including the dispensing wall.

17. The bite-actuate mouthpiece of claim 10, wherein the dispensing wall has an interior surface that faces the internal volume and wherein the interior surface extends from the one or more sidewalls at an acute angle.

18. The bite-actuate mouthpiece of claim 17, wherein the interior surface extends from the one or more sidewalls at an angle of at least 45°.

* * * * *